US010204515B2

(12) United States Patent
Mubarek et al.

(10) Patent No.: US 10,204,515 B2
(45) Date of Patent: Feb. 12, 2019

(54) AUTOMATED TRAFFIC SIGNAL OUTAGE NOTIFICATION WITH SPAT INFORMATION

(71) Applicant: HERE Global B.V., Eindhoven (NL)

(72) Inventors: Omer Mubarek, Chicago, IL (US); Bruce Bernhardt, Wauconda, IL (US); Jingwei Xu, Buffalo Grove, IL (US)

(73) Assignee: HERE Global B.V., Eindhoven (NL)

( * ) Notice: Subject to any disclaimer, the term of this patent is extended or adjusted under 35 U.S.C. 154(b) by 79 days.

(21) Appl. No.: 15/341,084

(22) Filed: Nov. 2, 2016

(65) Prior Publication Data

US 2018/0122227 A1 May 3, 2018

(51) Int. Cl.

| | |
|---|---|
| ***G08G 1/095*** | (2006.01) |
| ***G08G 1/01*** | (2006.01) |
| ***G08B 21/18*** | (2006.01) |
| ***G08G 1/0968*** | (2006.01) |
| ***G08G 1/097*** | (2006.01) |
| *G08G 1/07* | (2006.01) |

(52) U.S. Cl.

CPC ..... *G08G 1/0125* (2013.01); *G08B 21/18* (2013.01); *G08G 1/0112* (2013.01); *G08G 1/0133* (2013.01); *G08G 1/097* (2013.01); *G08G 1/096816* (2013.01); *G08G 1/096844* (2013.01); *G08G 1/07* (2013.01)

(58) Field of Classification Search

CPC .... G08G 1/0125; G08G 1/0145; G08G 1/052; G08G 1/0129; G08G 1/0112; G08G 1/0116; G08G 1/08; G08G 1/012; G08G 1/123; G08G 1/20; G08G 1/096775; G08G 1/096716; G08G 1/07; G08G 1/096741; G08G 1/0133; G08G 1/096816; G08G 1/096844; G08G 1/097; G08B 21/18; B60H 3/00

USPC ..... 340/907, 905, 909, 910, 916, 917, 931

See application file for complete search history.

(56) References Cited

U.S. PATENT DOCUMENTS

| | | | | |
|---|---|---|---|---|
| 7,639,159 | B2 * | 12/2009 | McNew | G08G 1/164 340/905 |
| 7,825,825 | B2 * | 11/2010 | Park | G08G 1/092 340/906 |
| 8,386,156 | B2 | 2/2013 | Miller | |

(Continued)

FOREIGN PATENT DOCUMENTS

| | | | |
|---|---|---|---|
| CN | 105427610 | A | 3/2016 |
| DE | 1020122216788 | A1 | 5/2014 |

OTHER PUBLICATIONS

PCT International Search Report and Written Opinion of the International Searching Authority dated Jan. 3, 2018 for corresponding PCT/US2017/053609.

*Primary Examiner* — Anh V La

(74) *Attorney, Agent, or Firm* — Lempia Summerfield Katz LLC

(57) ABSTRACT

A system and method are provided for determining malfunctioning traffic signals and lights. A traffic signal pattern is identified. Probe reports are received from a device. A path is generated including the road intersection for the device using location data in the two or more probe reports. The path is compared to a traffic signal. An abnormal crossing is determined from the comparison. A malfunction of the traffic signal is determined based on the abnormal crossing.

20 Claims, 19 Drawing Sheets

(56) References Cited

U.S. PATENT DOCUMENTS

| | | | | |
|---|---|---|---|---|
| 2003/0189499 | A1* | 10/2003 | Stricklin | G08G 1/0175 340/933 |
| 2011/0095908 | A1* | 4/2011 | Nadeem | B60H 3/00 340/905 |
| 2014/0336913 | A1 | 11/2014 | Fino | |
| 2016/0027299 | A1* | 1/2016 | Raamot | G08G 1/08 340/917 |
| 2017/0109715 | A1* | 4/2017 | Aguirre | G06Q 20/0652 |
| 2017/0228410 | A1* | 8/2017 | Slusar | G06F 17/30371 |

* cited by examiner

AUTOMATED TRAFFIC SIGNAL OUTAGE NOTIFICATION WITH SPAT INFORMATION

FIELD

The following disclosure relates to transportation systems and transit related applications, and more specifically to receiving traffic reports and identifying a traffic signal controlled intersection that is malfunctioning.

BACKGROUND

Intersections between roadways may include a traffic signal to facilitate traffic flow. A traffic signal may be able to provide control strategies for vehicle capacity and safe operation on the roadway. When a traffic signal malfunctions, traffic flow and safety may quickly diminish resulting in increased congestion and altered traffic patterns. The increased congestion and altered traffic patterns may last for extended periods of time until a responsible party is notified and dispatched to fix the malfunction.

Certain traffic signals may be directly connected to a central system. The central system may be able to immediately identify when the traffic signals malfunction. However, many traffic signals are unconnected. For example, many intersections contain legacy equipment that does not support external communication. The traffic signals may operate using an identified signal pattern, but have no ability to report a malfunction. The ability to quickly identify that a traffic light controlled intersection is malfunctioning and report that situation to a traffic management agency, police agencies, and/or vehicles traveling to the intersection is needed to efficiently and effectively provide navigation services.

SUMMARY

In an embodiment, a method is provided for determining when a traffic signal associated with a road intersection is malfunctioning. The method comprises identifying a traffic signal pattern and receiving two or more probe reports from a device. A path is generated including the road intersection for the device using location data in the two or more probe reports. The path is compared to a traffic signal. An abnormal crossing is determined from the comparison. A malfunction of the traffic signal is determined.

In an embodiment, a system is provided for determining when a traffic signal associated with a road intersection is malfunctioning. The system comprises a map database, a sensor ingestion module, a routing module, and an analytics module. The map database is configured to store data relating to the road intersection and signal, phase, and time data for the traffic signal. The sensor ingestion module is configured to receive two or more probe reports from a sensor associated with a vehicle. The routing module is configured to generate a path for a crossing of the road intersection for the vehicle from the two or more reports. The analytics module is configured to analyze the path and the signal, phase, and time data to determine if the crossing of the road intersection is an abnormality, the analytics module further configured to determine a malfunction of the traffic signal based on the abnormality.

In an embodiment, a method is provided for generating an updated route. The method comprises receiving a request for a route, generating the route, and providing the route. A road intersection with a malfunctioning traffic signal is identified from one or more vehicle paths through the road intersection and signal, phase, and timing information for the malfunctioning traffic signal. An updated route is generated and provided.

BRIEF DESCRIPTION OF THE DRAWINGS

Exemplary embodiments of the present invention are described herein with reference to the following drawings.

DETAILED DESCRIPTION

Embodiments are provided that detect malfunctioning traffic signals that are not connected to a central controller but for which the signal phase and timing information is known. Embodiments use crossing paths through the intersection and the signal, phase, and timing information to identify abnormal crossings. A status of the traffic signal is derived from the abnormal crossings.

Figure 1A:
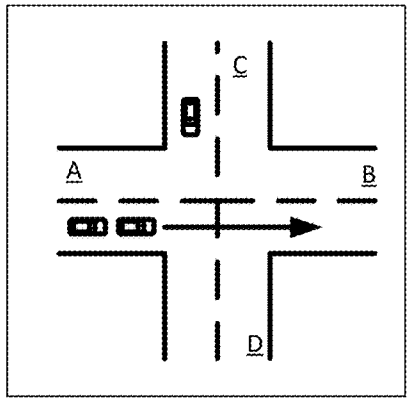
FIGS. 1A, 1B, and 1C illustrate an example intersection and signal timing pattern.
Figure 1B:
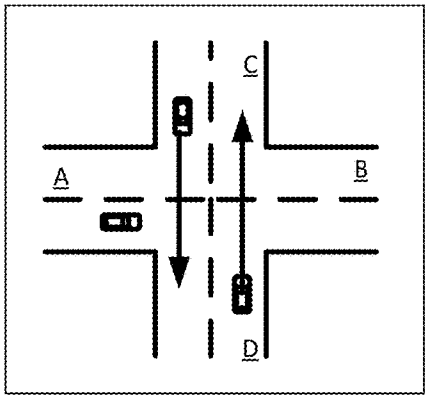

FIGS. 1A and 1B illustrate a four-way intersection. In FIGS. 1A and 1B, the intersection includes four traffic lights; one for each direction (up, down, left, right). For a four-way intersection, the traffic lights may operate in pairs. Two complementary lights of the four lights may correspond to the vertical paths from A to B (and B to A). Two of the four lights may correspond to the horizontal paths from C to D (and D to C). In normal operation, the horizontal paths (from left to right and right to left) have a green light together while the vertical paths (from top to bottom and bottom to top) have a red light. For traffic signals that include a yellow light, the pattern of operation may be: green light for a first period, yellow light for a second period, and then a red light for a third period. The red light of a complementary traffic light may be used when the first traffic signal is green or yellow prohibiting any two perpendicular streams of traffic from entering the intersection at the same time. The length of the periods for green, yellow, and red may be set to manage traffic flows. For example, a major roadway may have a longer green than a minor roadway at the intersection of the two.

Figure 1C:
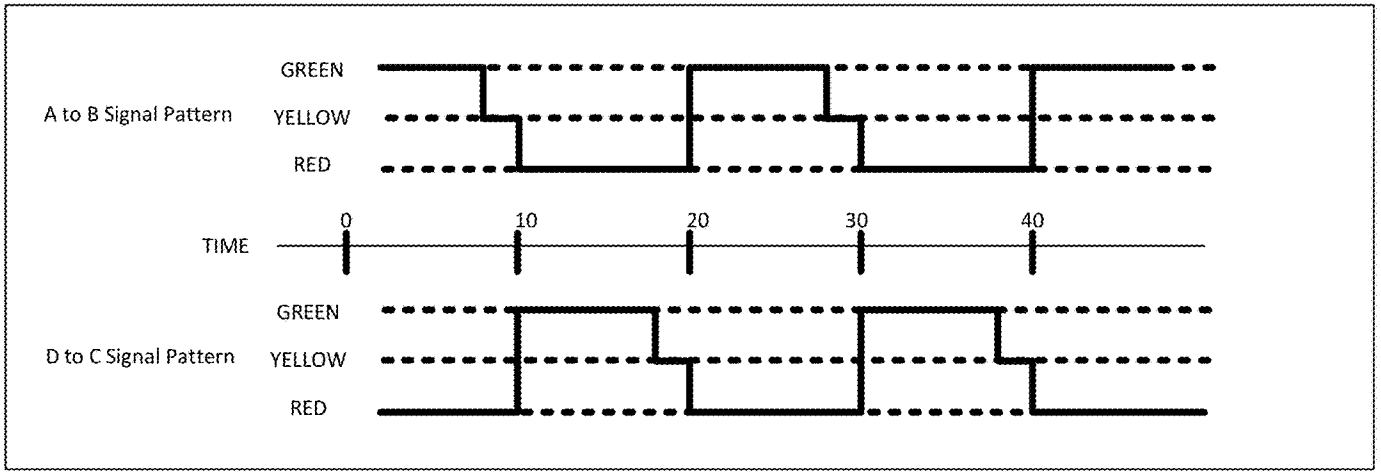

For the traffic signals used herein, the signal, phase, and timing (SPaT) information may be available. Figured 1C illustrates SPaT information for the traffic signal of FIGS. 1A and 1B in a line graph. The SPaT information may include the timing and cycle for each light and/or each lane of the traffic signal. For example, the central controller may identify that a particular traffic light of the traffic signal is green for eight seconds (e.g. 0:00-0:08), yellow for two seconds (0:08-0:10), and then red for ten seconds (0:10-0:20). The signal pattern may then repeat indefinitely. If the pattern begins at, for example 12:00:00, the central controller may be able to identify that at 13:37:45 on a Wednesday, the traffic light should be green. FIG. 1C further includes the signal pattern for FIG. 1B (vertical traffic, e.g. the D to C pattern). The second traffic light may be a complementary traffic light of the first traffic light, e.g. the first light is for the horizontal paths, the second light is for the vertical paths. As depicted in FIG. 1C, the timing and cycle of the second light is complementary of the first light. When the first light is green or yellow, the second light is red and vice versa. More complex patterns may be used, for example, depending on the time of day, day of the week, type of intersection, number of lanes, etc. The SPaT information for each traffic signal may be published by a governmental agency and/or accessed over a network. In the scenario where traffic signals are connected to a central entity, the status of lights is known by the central entity; and there may be no need for a system or method to automatically detect malfunctioning traffic lights from probe reports. Here, with unconnected traffic lights, the status may only be predicted based on the SPaT information and an expectation that the traffic signal has not malfunctioned.

Figure 2C:
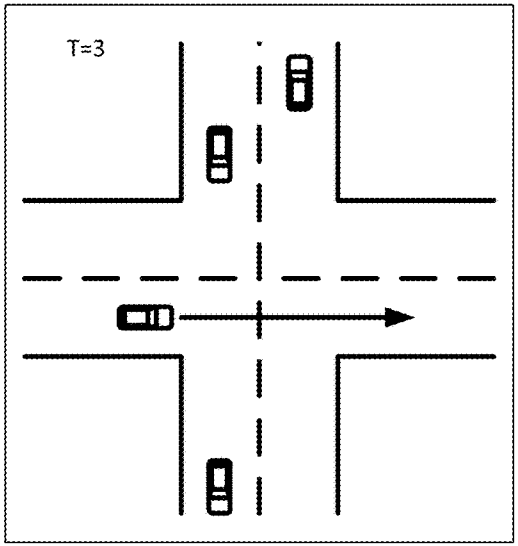
FIGS. 2A, 2B, and 2C illustrate an example intersection with a malfunctioning traffic signal.
Figure 2B:
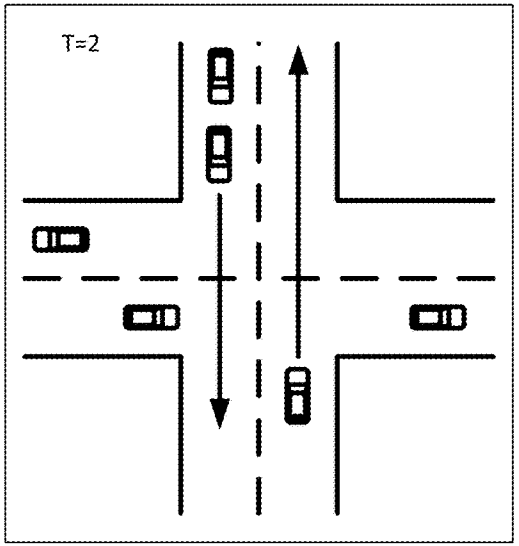
Figure 2A:
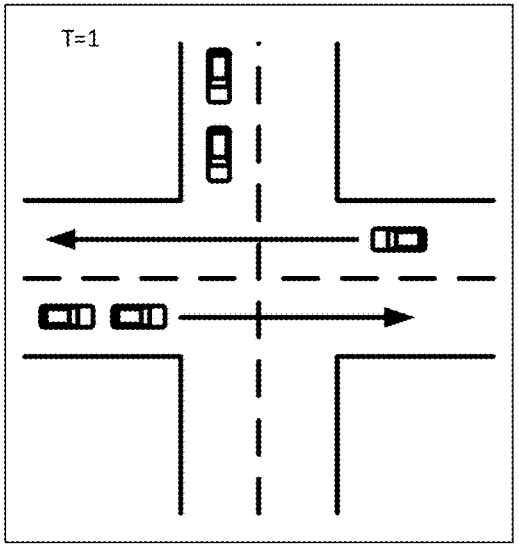

When a traffic signal malfunctions, the normal flow of traffic may be altered. If the traffic signal is off or flashing red lights (one default position of a malfunctioning traffic signal) the traffic pattern may resort to a one vehicle through the intersection at a time method. The resulting traffic pattern may resemble a four-way intersection with stop signs. Priority right of way rules may be used. In a four-way intersection, traffic from the right generally has priority. For traffic coming from the same or opposite direction, the traffic that goes straight has priority over the traffic that turns. FIGS. 2A, 2B, and 2C illustrate a malfunctioning traffic signal controlled intersection at three different times T=1, T=2, and T=3. In FIG. 2A, one vehicle from each horizontal path may be allowed to cross the intersection. After the vehicles have crossed the intersection, at FIG. 2B, one vehicle from each vertical path may be allowed to cross. At FIG. 2C, after the vertical vehicles have crossed, another vehicle from the horizontal path may cross. The pattern: horizontal, vertical, horizontal, vertical will repeat until the malfunctioning light is fixed. If only one of the traffic signals at an intersection has malfunctioned (e.g. remains red), the traffic pattern may resemble a roadway that has a two way stop sign. More complex pattern may emerge when turning lanes are introduced.

A traffic signal malfunction may cause multiple issues including but not limited to increase congestion surrounding the intersection, less traffic flow, and increased travel times. Identifying and fixing the traffic signals that have malfunctioned is a high priority to maintain a proper functioning roadway. A current method for identifying traffic signals that are malfunctioning is to receive a message from an observer of the malfunctioning traffic signal. For example, a driver or pedestrian may send a text message or call a general purpose number (e.g. 311) to report the malfunction. Manually reporting the malfunction is inefficient, error prone, and must pass through multiple channels. The result is that a malfunctioning traffic light may remain out of service for an extended period of time exacerbating traffic issues.

Embodiments herein provide a system and method for determining that a traffic signal has malfunctioned. The following embodiments identify vehicle paths before, at, and after an intersection controlled by a traffic signal to detect abnormal behavior. The abnormal behavior is analyzed to determine if the traffic signal is malfunctioning. Vehicle paths may be generated from probe reports from a vehicle that travels the path. The vehicle paths are compared to SPaT information for the traffic lights. A traffic signal is assigned a score that measures the number of abnormal vehicle paths (e.g. through a red light). Once a threshold score has been reached in time period, the traffic signal may be identified as malfunctioning.

The disclosed embodiments may be implemented to optimize managing a roadway network and navigation services leading to an improvement in the computational system. The embodiments improve the efficiency and function of a navigation application. The embodiments improve the efficiency and operation of traffic signals by quickly identifying malfunctions. The increased efficiency and usage of resources may lead to less downtime, quicker response time, less congestion, and more efficient use of the roadway network.

Figure 3:
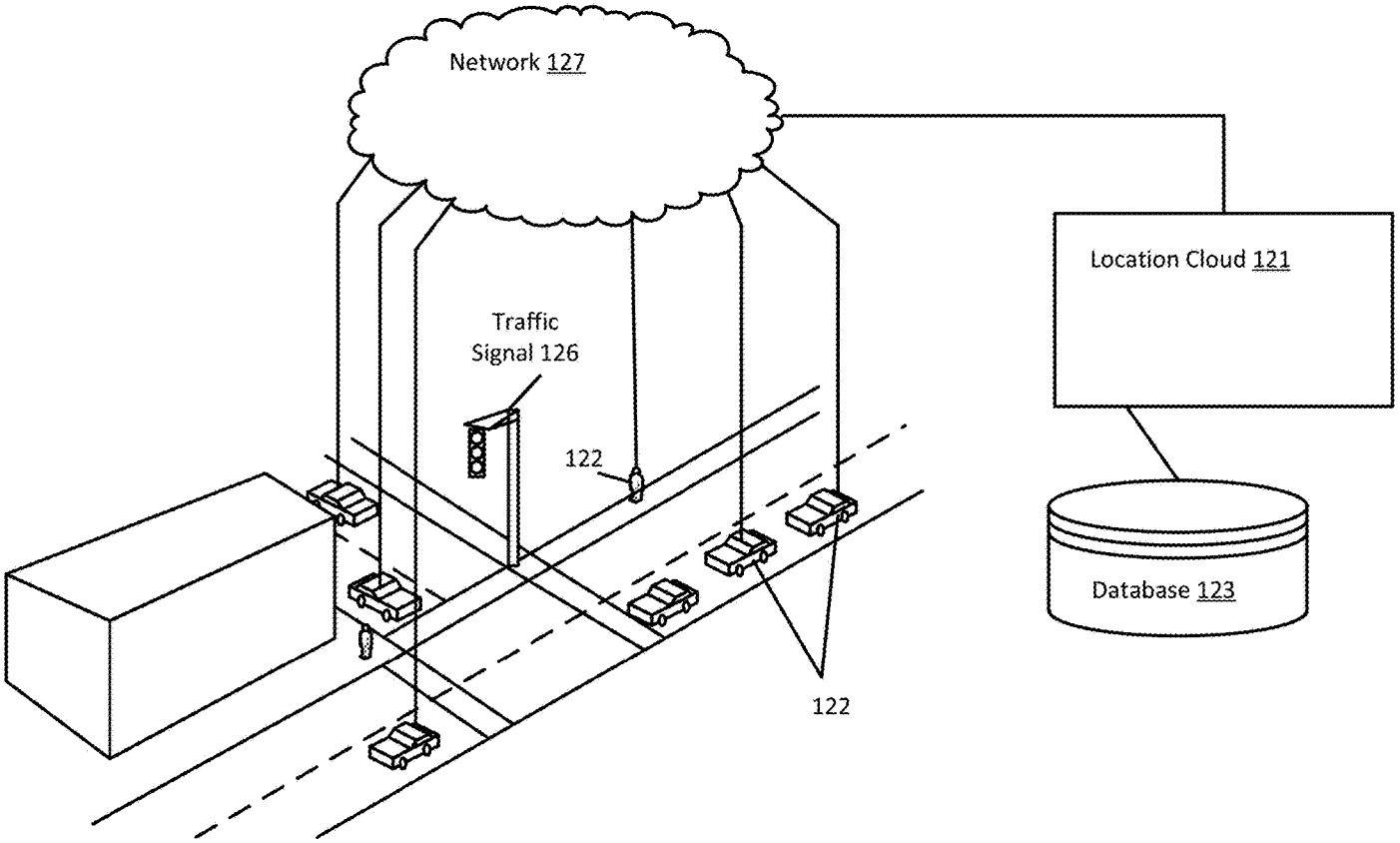
FIG. 3 illustrates an example system for identifying a malfunctioning traffic signal.

FIG. 3 illustrates an example system for identifying a traffic signal malfunction. The system includes one or more devices 122, a network 127, a traffic signal 126, and a location cloud 121. The device(s) 122 are coupled with or wirelessly connected to the network 127 that is coupled with or wirelessly connected to the location cloud 121. Herein, the phrase "coupled with" is defined to mean directly connected to or indirectly connected through one or more intermediate components. Such intermediate components may include both hardware and software based components. Additional, different, or fewer components may be included.

The traffic signal 126 may not be connected to the network, the devices 122, or the location cloud 121. The traffic signal 126 may include one or more traffic lights that facilitate movement of one or more vehicles through an intersection. The SPaT information for the traffic signal 126 may be identified and stored in the database 123.

The device(s) 122 may be a mobile device or a sensor that provides samples of data for the location of the device 122 or a vehicle. The device(s) 122 may be mobile phones running specialized applications that collect location data as the devices 122 traverse a roadway network. The device(s) 122 may also be integrated in or with a vehicle. Applications, computer sub-systems or sensors that are either standard or optional equipment on a vehicle may collect and aggregate information regarding the operation of the vehicle. The device(s) 122 may also be a sensor or a collection of sensors, such as an inductance loop or optical detector (e.g., camera, light detection and ranging (LiDAR), or radar device). The device(s) 122 may be a camera/ imaging sensor for gathering image data (e.g., the camera sensors may automatically capture traffic flow information, abnormal incidents, and/or traffic light information. The device(s) may be sensors located on the perimeter of the vehicle in order to detect the relative distance of the vehicle from lane or roadways, the presence of other vehicles, pedestrians, traffic lights, potholes and any other objects, or a combination thereof. The device 122 may operate from a fixed position and may be permanently deployed or a portable device that is located temporarily in the vicinity of a traffic incident, road construction, or a special event.

The device(s) 122 and/or other sensor(s) may be the means for collecting data from one or more vehicles. The data may be transmitted over the network. The device(s) 122 may also be configured to receive data through the network. The received data may include routing or navigation data, video data, audio data, or data relating to the device 122 or vehicle.

Additional equipment may be included in the system. For example, in certain embodiments, the system may include environmental sensors, connected traffic signals, dynamic message signs, CCTV cameras and video image processing systems, grade crossing warning systems, and ramp metering systems. Lane management systems and barrier systems that control access to transportation infrastructure such as roadways, bridges and tunnels may also be included. Work zone systems including work zone surveillance, traffic control, driver warning, and work crew safety systems may also be included. The equipment may be connected to the network in order to collect and provide information relating to the roadway network.

The network 127 may include wired networks, wireless networks, or combinations thereof. The wireless network may be a cellular telephone network, LTE (Long-Term Evolution), 4G LTE, a wireless local area network, such as an 802.11, 802.16, 802.20, WiMax (Worldwide Interoperability for Microwave Access) network, or wireless short range network such as Dedicated Short Range Communications (DSRC/802.11P). Further, the network 127 may be a public network, such as the Internet, a private network, such as an intranet, or combinations thereof, and may utilize a variety of networking protocols now available or later developed including, but not limited to TCP/IP based networking protocols. The network 127 may be the means for transmission of data between the devices 122, the location cloud 121, and/or other equipment or devices in the system.

The location cloud 121 may include one or more servers, workstations, databases, and other machines connected together and maintained by a manager of connected vehicle data, including but not limited to map, sensor, wireless network, temporal climate and incident data. The term location cloud 121 is used herein to collectively include the ingestion, analytic/computational, interface API's and message distribution capabilities residing in both local and cloud based systems including the systems used for creating, maintaining, accessing, and updating one or more database(s) 123. The location cloud 121 (or traffic management system) may include one or more server(s) 125 or modules such as a sensor ingestion server, a traffic management server, and/or an analytics server. The location cloud 121 may also include a database 123. The location cloud 121 may be configured to provide up to date information and maps to external map databases or mapping applications. The location cloud 121 collects or ingests data from multiple sources, such as through the network 127, in order to maintain up to date roadway conditions. Data such as device data, sensor data, weather, road conditions, traffic flow, and historical data is processed to determine current and future traffic conditions. The location cloud 121 may generate map updates, such as real time traffic updates, turn by turn directions, public transportation routes and information about local business and attractions.

The location cloud 121 may be the means for determining a status of a traffic signal 126 from collected data. The location cloud 121 may be configured to update a map database 123, generate a route, or transmit an alert message related to the status of the traffic signal 126. The location cloud 121 may receive information relating to one or more devices 122 over the network 127. The location cloud 121 may be configured to estimate a device's 122 path based on the received information. The location cloud 121 may be configured to compare the path to a traffic signal pattern to determine abnormal traffic patterns. The location cloud 121 may be configured to determine a malfunction of a traffic signal 126 from the abnormal traffic patterns. The location cloud 121 may store the traffic patterns and malfunctions in the database 123. The location cloud 121 may be configured to generate messages for transmission to devices 122 describing preemptive actions to be taken to avoid malfunctioning traffic signals 126.

The database 123 (also referred to as a dynamic content database, sensor ingestion database, traffic database, map database or geographic database) may include geographic data used for traffic or navigation related applications. In order to provide navigation related features and functions to the end user, the location cloud 121 uses the geographic database 123. The geographic database 123 includes information about one or more geographic regions including attributes and data relating to one or more nodes, one or more road segments, and one or more traffic intersections. The geographic database 123 may further include data relating to one or more traffic signals 126 including SPaT information for one or more traffic signals 126.

Figure 4:
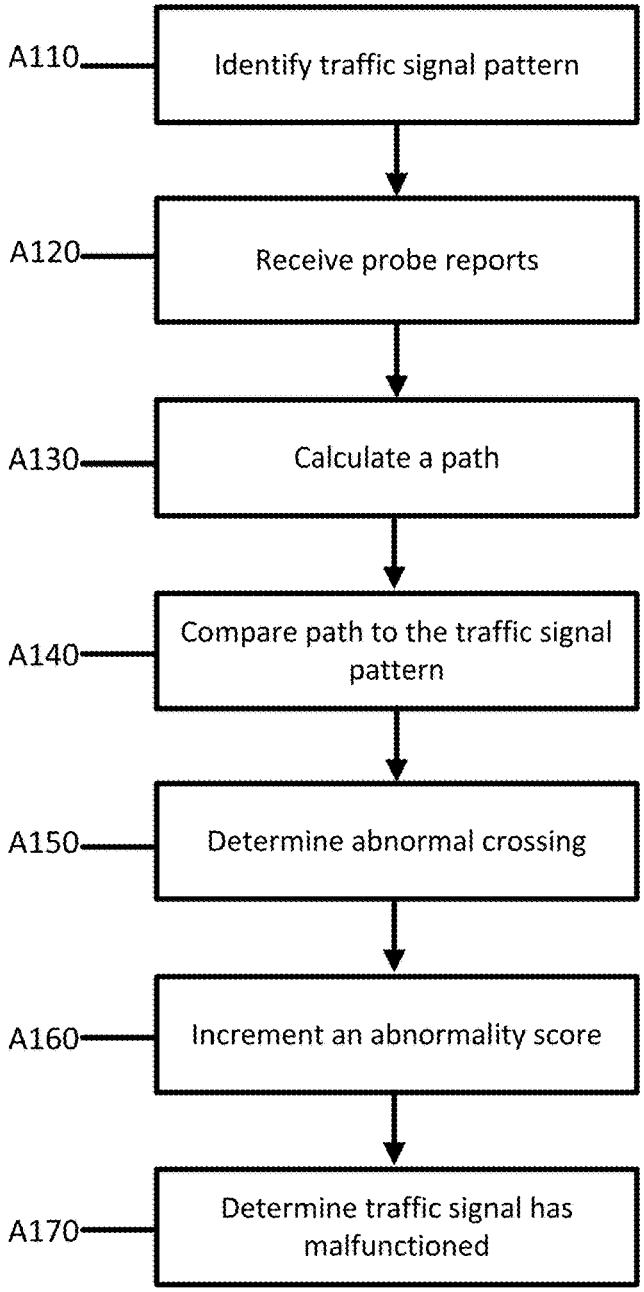
FIG. 4 illustrates an example workflow for identifying a malfunctioning traffic signal.

FIG. 4 illustrates a flow chart of a method for identifying a malfunctioning traffic signal 126 using the system of FIG. 3. As presented in the following sections, the acts may be performed using any combination of the components indicated in FIG. 3. The following acts may be performed by the device 122, the location cloud 121, or a combination thereof. Additional, different, or fewer acts may be provided. The acts are performed in the order shown or other orders. The acts may also be repeated.

At act A110, the location cloud 121 identifies a traffic signal pattern for a traffic signal 126 located at an intersection. Traffic signals 126 may be connected or unconnected. A connected traffic signal 126 may be monitored over a network. An unconnected traffic signal 126, however, may not be able to communicate with external devices. Unconnected traffic signals 126 may herein be referred to as just traffic signals 126. While the actual status of a traffic signal 126 may not be known, the signal, phase, and timing of the traffic signal 126 may be identifiable. The signal, phase, and timing information or SPaT information may include data that describes the operation of a traffic signal 126. For example, the SPaT information may include what type of lights the traffic signal 126 includes, what order the lights operate in, and the timing of the operation of the lights. The SPaT information describes the state of a traffic signal 126 at an expected time. The SPaT information may be received from a traffic management agency, e.g. a traffic management center that is responsible for maintaining the intersection. The SPaT information may be provided to the location cloud 121 in a table format covering a repeating traffic cycle or may be provided real time by an agency responsible for the traffic signal 126.

In certain embodiments, SPaT information may be derived from historical traffic data relating to the intersection. Using previously received probe reports, the location cloud 121 may be able to identify the SPaT information from the operation of vehicle around the intersection. In certain embodiments, the derived SPaT information may be compared to received SPaT information in order to verify or match up the cycles. While the signal pattern may be correct in the SPaT information, if the start of the cycle is off, the information may not match up with the actual operation of the traffic signal 126.

At act A120, the location cloud 121 receives two or more probe reports from a device 122 that has entered the intersection. The device 122 may be a vehicle that has traveled through the intersection. A report (or probe report) from a device 122 may include information such as location, speed, and time of the device 122. Location data may be derived from a positioning sensor such as a global positioning system (GPS) device. The speed of the device 122 may be determined by one or more sensors. The speed may be derived from two or more reports from the device 122 if the reports include location and time. Additional data relating to the device 122, vehicle, or roadway may be included in the report. The two or more reports may be received separately or together in a group or batch. The two or more reports may be received in real-time or may be delayed due to network equipment or latency.

A first report of the two or more reports may include a location prior to the intersection. A second report of the two or more reports may include a location subsequent to the intersection. A third report of the two or more reports may include a location in the intersection. Additional reports that include alternative locations may be received. Multiple reports, for example, may include locations prior to the intersection. If, for example, a report is generated every ten seconds, a thirty second wait at an intersection may include three generated and transmitted reports.

At act A130, the location cloud 121 calculates a path through the intersection for the device 122 including one or more estimated locations at one or more times. The location cloud 121 uses the received two or more reports to determine where and when the device or vehicle traveled. The path may be estimated using the two sets of location and timing data, and other information from the two reports. For example, a path may be generated by drawing a line between the two points. While the location cloud 121 may be unable to determine exactly where the vehicle was on the path at any time, the location cloud 121 may determine that the vehicle passed through a line perpendicular to the path at some point between the first time and second time included in the two reports. The perpendicular line may represent the middle of the intersection or the entrance of the intersection. The location cloud 121 may use more than two reports to calculate the path. Positional data may be flawed due to visibility, signal obstruction, or multipath errors. A single location may be off by a distance larger than the distance between the start of the intersection and the middle of the intersection. The location of the vehicle may be erroneously identified as after the intersection when the vehicle is still waiting at the light and vice versa. Additional location point may assist the location cloud 121 in determining an accurate path. Other information in the reports, such as speed may be used to calculate the path.

At act A140, the location cloud 121 compares the path to the SPaT information. The path indicates at least two points and a distance traveled between the two points. The path includes a start time (the first point) and an end time (the second point). In between the two points is the intersection relating to the traffic signal 126. The location cloud 121 determines that at some point between the start time and end time, the vehicle performed a crossing of the intersection. The timing of the crossing and the SPaT information may be compared to determine if the path includes a crossing on a red light, a green light, a yellow light, or an indeterminate crossing (e.g. ending on a red but having an unknown start). The comparison of the SPaT information and path is illustrated in FIGS. 5-10 described below.

Figure 5:
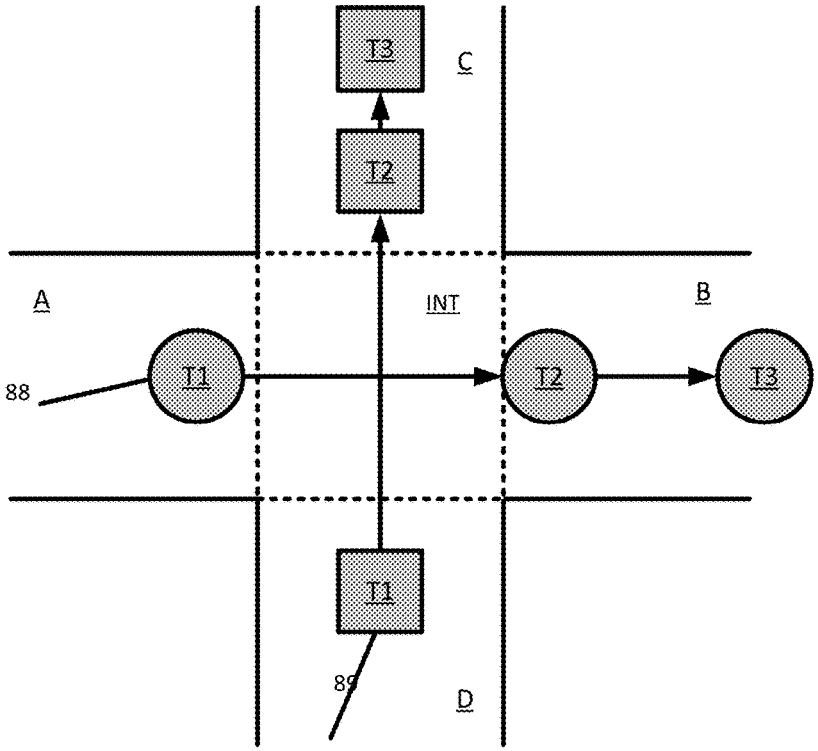
FIG. 5 illustrates an example scenario depicting a crossing of an intersection.
Figure 5:
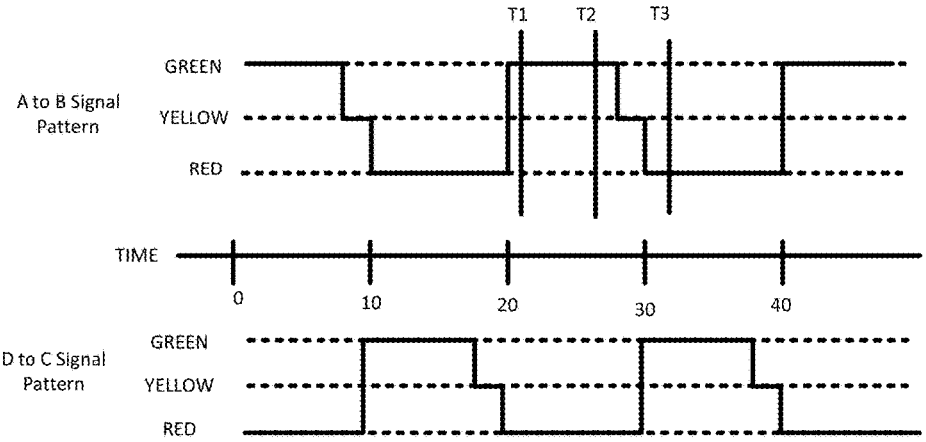

At act A150, the crossing is determined to be either normal or abnormal. FIG. 5 depicts an example intersection crossing and signal timing. The example in FIG. 5 includes a two-way intersection including a horizontal path (from A to B) and a vertical path (from D to C). The center of the intersection may be referred to as INT. For this example, there are two vehicles represented by a square and a circle. The locations of the two vehicles (88, 89) change over time as the vehicles move through the intersection. Each vehicle may provide a report at three separate times. Three reports for each vehicle are provided (T1, T2, and T3) representing three subsequent reports. The reports may have been received, for example, at act A120. The reports include a location and time of the vehicle and are used to determine the vehicle's path through the intersection. For example, vehicle 88 crosses through the intersection between time T1 and T2. The crossing is derived from the first report at T1 that shows vehicle 88 located in the circle with T1. The second report at T2 includes information that locates the vehicle 88 in the circle with T2. Accordingly, at some point between T1 and T2, vehicle 88 passed through INT from A to B.

Vehicle 89 also passes through the intersection between T1 and T2. The time periods may be matched against the SPaT information to determine if each crossing was normal. For example, for Vehicle 88, if at some point during T1 and T2, the traffic signal 126 was green, the crossing may be considered normal. If, however, the traffic signal 126 was red the entire time between T1 and T2, the crossing may then be determined as abnormal. Abnormal, here indicating an event that is not expected with a working traffic signal 126. As depicted in the A to B signal pattern, both T1 and T2 fall within a period where the signal is green. T3 occurs at a point where the signal has turned to red, but the vehicle 88 has already passed through the intersection.

Additional considerations may be used to determine if crossing are abnormal or normal. For example, many traffic signals 126 include yellow lights. Vehicles may enter the roadway when there is a yellow light or even a red light and still successfully cross the intersection. Using only the red/green light pattern may treat such a crossing as an abnormality when, in fact, the traffic signal 126 was fully functional. In order to account for such behaviors, a buffer time may be added to the red/green light pattern to account for late crossings.

Traffic congestion after a traffic signal 126 may also be used to determine if crossings are abnormal or normal. A vehicle may enter an intersection on a green but be unable to complete a crossing due to too much capacity or an accident blocking the intersection. The vehicle may then be stuck in the middle (INT) section until the congestion clears.

FIGS. 5 through 10 illustrate five example of determining if a crossing is abnormal. FIGS. 5 through 10 depict similar two-way intersections. Each figure includes a horizontal path for the route from the left (A) to the right (B) and a vertical path from the bottom (D) to the top (C). The horizontal path has a green light at a given time interval. Vehicles traveling in this direction are permitted to enter and pass through the intersection during this time interval. The horizontal path also has a red light for a different time interval. Vehicles are prohibited from entering from A and crossing the intersection during this time interval. The transition between the green and red lights includes a short yellow light. The timing for the A to B signal pattern is shown at the bottom. In the time graph, at Time=0, the A to B traffic signal is green. At approximately Time=8, the signal switches to yellow. At Time=10, the traffic signal 126 switches to Red. This pattern repeats itself.

The vertical direction from D to C has a red light at a given time interval. Vehicles in this direction are prohibited from entering and crossing the intersection for this time interval. The vehicles are expected to wait before the intersection for the light's phase to turn green. After the red light, the traffic signal 126 is green. Vehicles are permitted to enter from this direction during this time interval. The traffic signal 126 for D to C mirrors the traffic signal 126 for the A to B traffic signal 126. When the traffic signal 126 for A to B is green or yellow, the traffic signal 126 for D to C is red and vice versa. In this way, both directions may never both have a green or yellow light. The traffic signal patterns for both traffic signals 126 may be more complex, e.g. changing over time due to expected congestion or may include additional phases such as a delay between when one light turns red and the other turns green. Different lanes may have different signals such as turn signals. For each vehicle two or more probe reports may be received. The probe reports may be received at act A120. The paths of the vehicles may be calculated at act A130.

In FIG. 5, both vehicle paths cross the intersection during the period between T1 and T2. In this example, using the signal patterns, the location cloud 121 may determine that vehicle 88 crosses the intersection on a green light. Likewise, vehicle 89 crosses on a red light. Vehicle 89 does not obey the expected signal phase of the traffic light. The crossing of vehicle 89 on the red light may be due to a traffic light malfunction. The crossing is determined to be abnormal.

Figure 6:
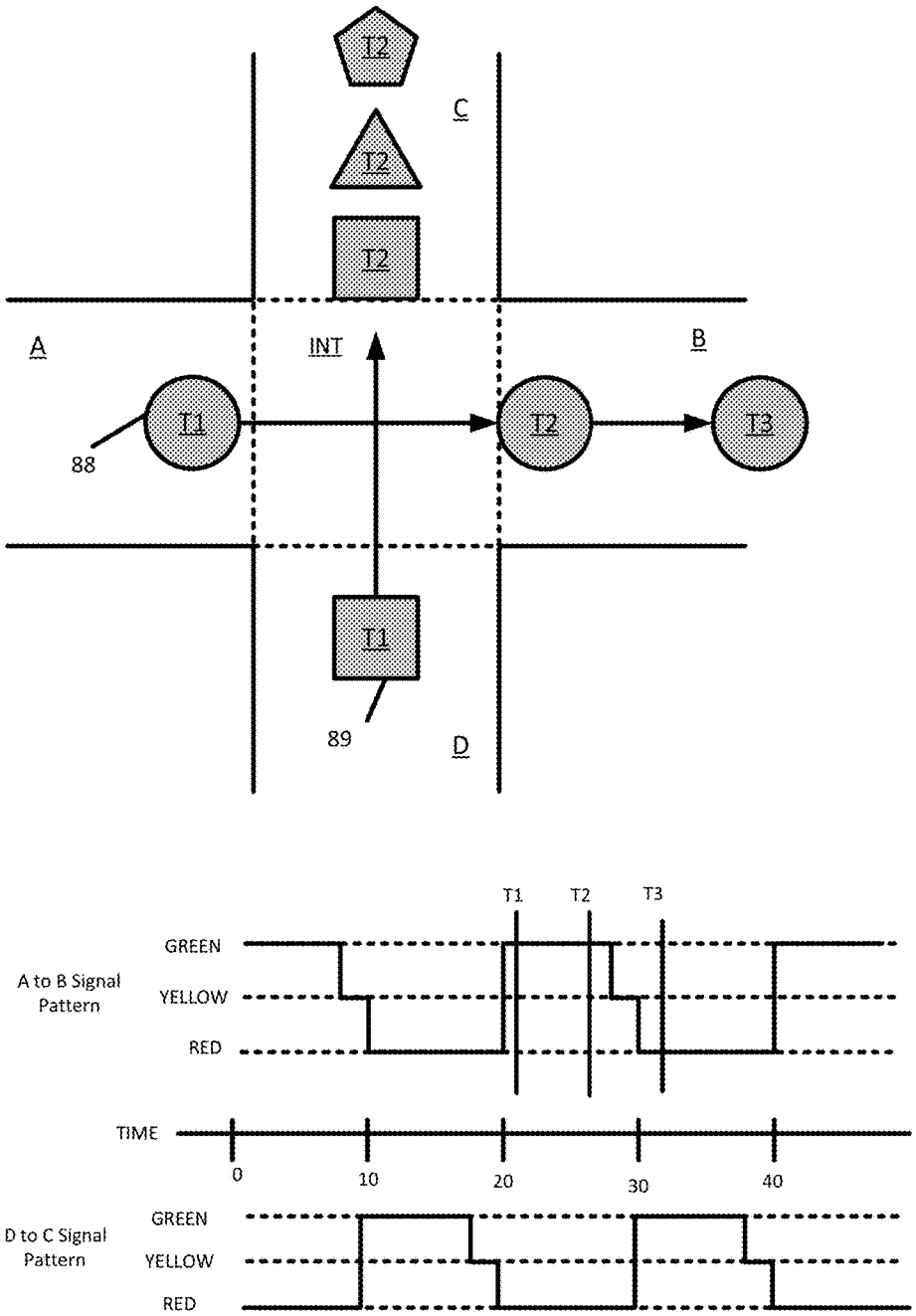
FIG. 6 illustrates another example scenario depicting a crossing of an intersection.

In FIG. 6, vehicle paths cross the intersection during the period between T1 and T2. In this example, vehicle 88 crosses the intersection on a green light. Vehicle 89 crosses on a red light. Vehicle 89 does not obey the expected signal phase of the traffic light which could be due to light malfunction. There is congestion at C in vehicle 89's path. Here, however, congestion does not affect the determination as vehicle 89 enters and crosses the INT section under a red light. The crossing is determined to be abnormal.

Figure 7:
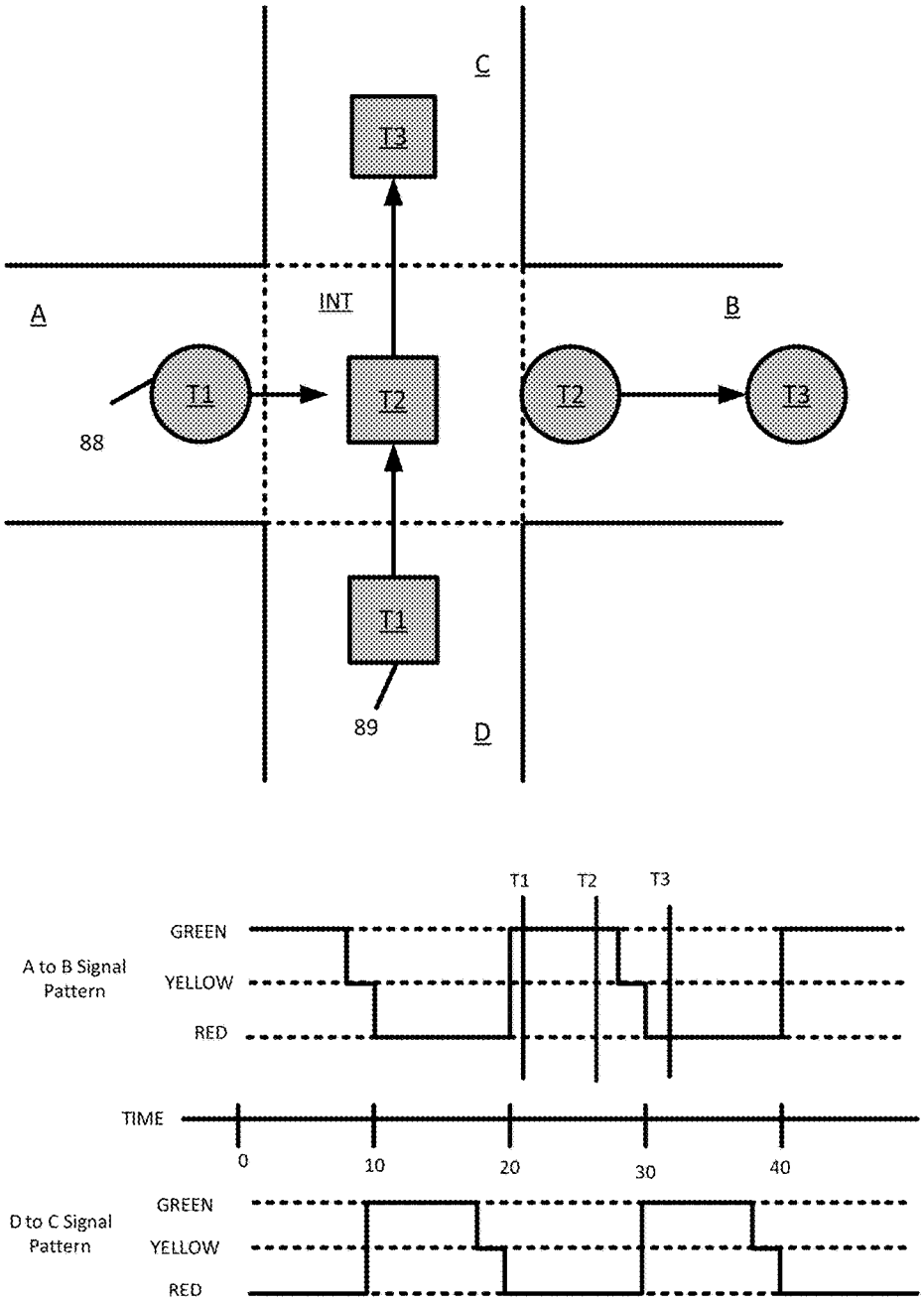
FIG. 7 illustrates another example scenario depicting a crossing of an intersection.

In FIG. 7, a vehicle 89 has a path from D to INT to C. There is no congestion at C. The vehicle 89 enters the intersection on a red light. The third location point at T3 may be green, but the vehicle 89 has already made an abnormal crossing by entering the intersection (INT) on a red light.

Figure 8:
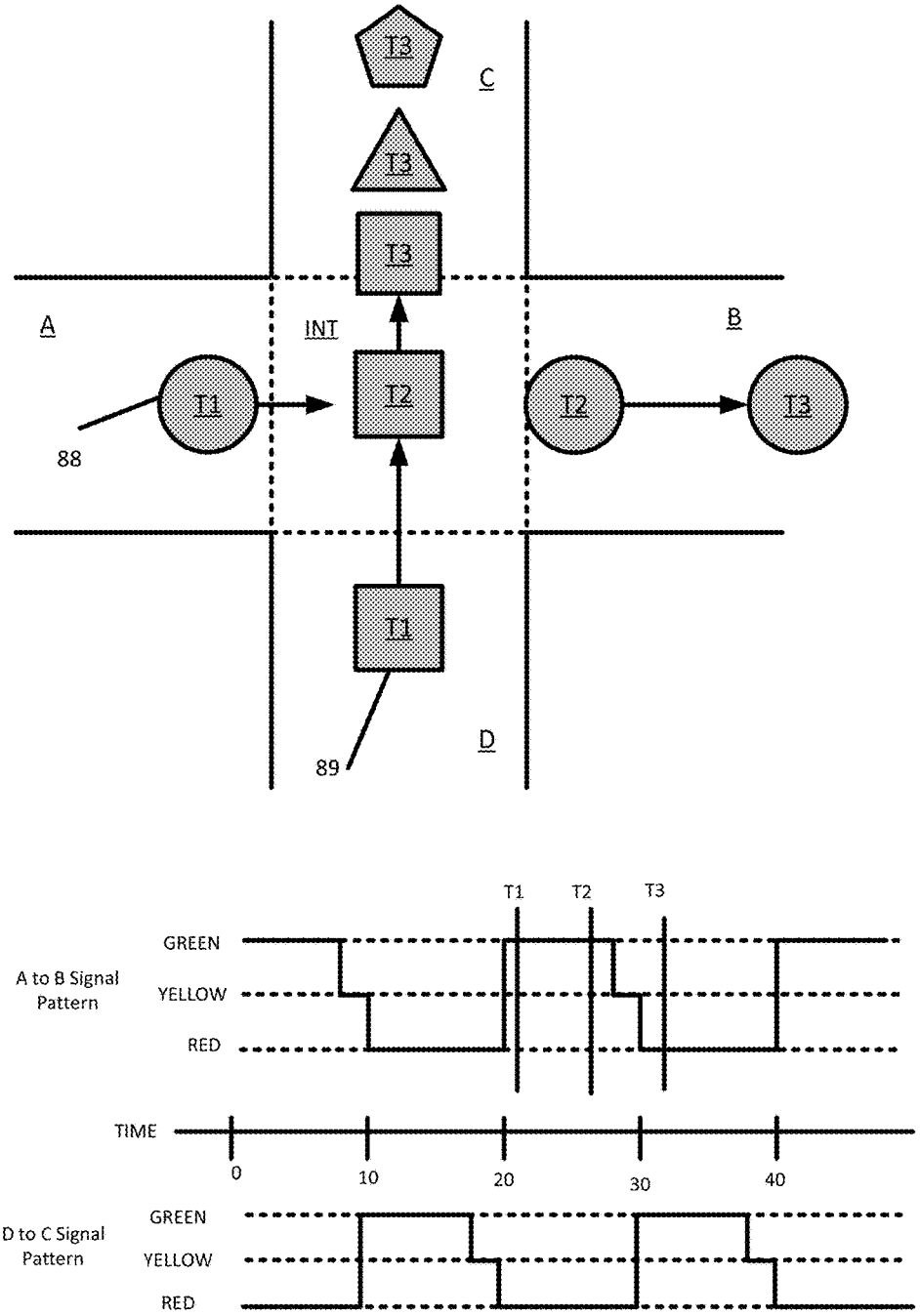
FIG. 8 illustrates another example scenario depicting a crossing of an intersection.

FIG. 8 is similar to FIG. 7 except that in this scenario there is congestion at C. The vehicle 89 has a path from D to INT to C. At T3, the light has turned green. Congestion, however, in this scenario does not change the determination. The vehicle 89 entered the intersection during a red light phase and thus the crossing is abnormal.

Figure 9:
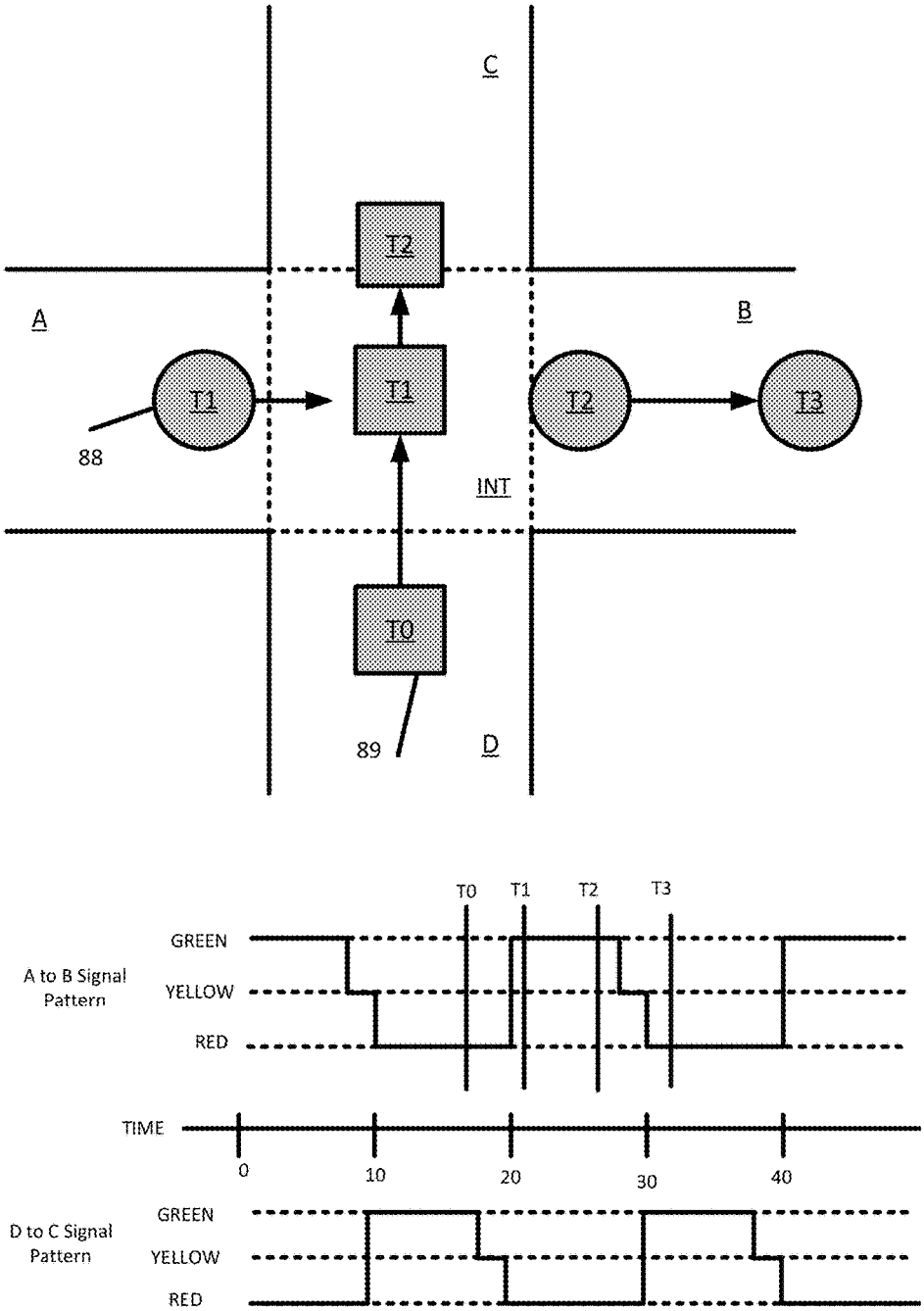
FIG. 9 illustrates another example scenario depicting a crossing of an intersection.

In FIG. 9, there is a path from INT to C on a red light for vehicle 89. In this scenario, there may be a number of vehicles that transmit a probe report before the intersection when traffic light is supposed to be green and probe reports at the intersection as well as after the intersection after the light supposed to turn red. This scenario is frequently observed when vehicles speed up to make it through the green light and are not successful. In order to eliminate these false positives, a time buffer may be used that limits abnormal crossing to a time after the time buffer has elapsed at the beginning of a new traffic light phase. The time buffer may correspond to a yellow light phase of the traffic light. Using the time buffer, a determination is made if the probe report at T1 is just an illegal or late crossing rather than an abnormal crossing. If, for example, the time buffer is 2 seconds and the probe report for T1 is less than 2 seconds after the red phase, the crossing may be determined to be just a late crossing. If the probe report at T1 is, for example, 5 seconds after a red light phase has begun, the crossing may be determined to be abnormal. In the example in FIG. 9, T1 occurs approximately 1 second after the yellow phase ends for the D to C signal pattern. Using the time buffer, the location cloud 121 may identify this crossing as a normal late crossing.

Figure 10:
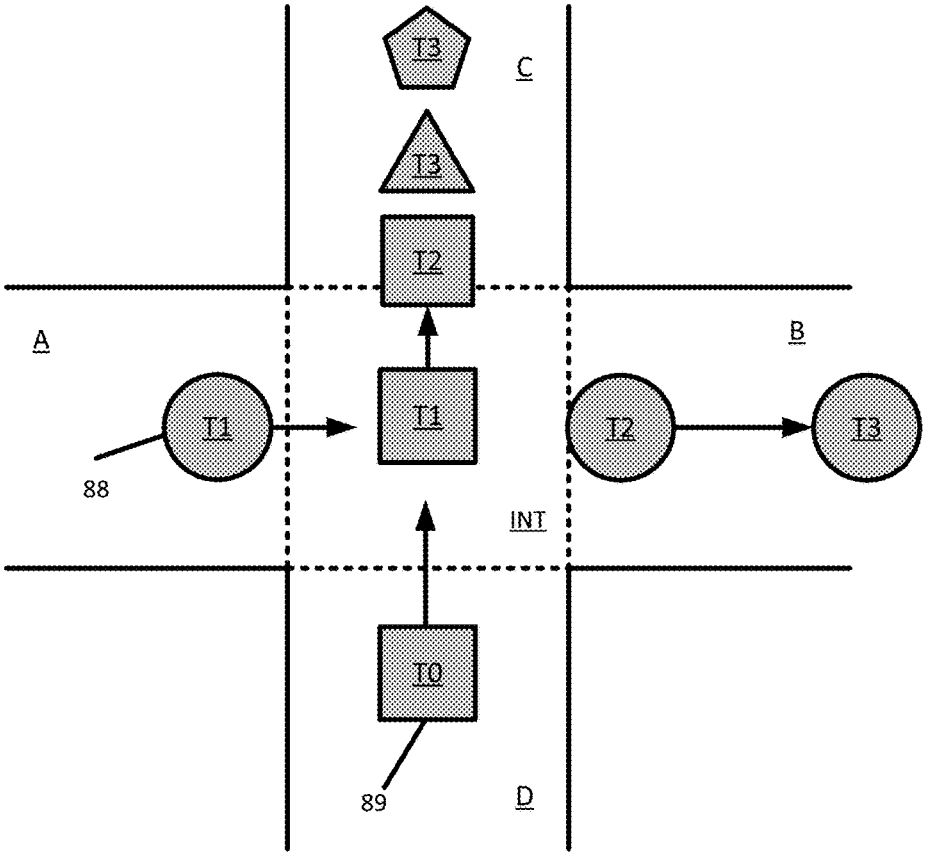
FIG. 10 illustrates another example scenario depicting a crossing of an intersection.
Figure 10:
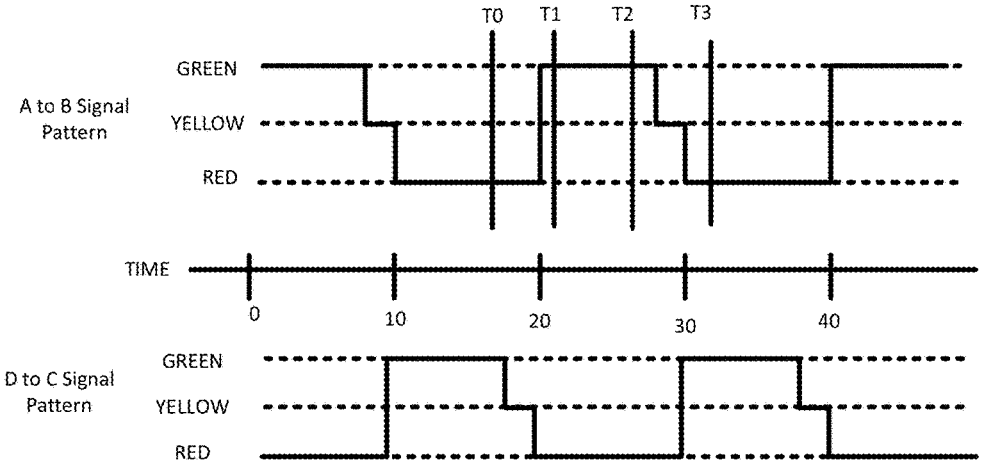

In FIG. 10, vehicle 89 has one probe at the intersection and another one after the intersection both when the light status is red. However, vehicle 89 also has a probe before the intersection when the light status was green. As in FIG. 9, a time buffer may be used to account for vehicles trying to make the light and crossing the intersection at red. However, due to the fact that there is congestion after the intersection may cause vehicles lingering at the intersection for a longer time than the time buffer essentially slowing the crossing of the vehicle 89. As such, a normal crossing may be determined.

Each of the examples described above include a two-way intersection. Two-way intersection scenarios can be generalized to multi-way intersections. Similar to two-way intersection, all paths are classified based on if they occurred during a red light phase or green light phase. The above scenarios from FIG. 5-10 along with their sub-scenarios if any are evaluated for each path individually. If any of the traffic lights are detected as malfunctioning, then the method may identify the entire traffic signal 126 as malfunctioning.

Each of the above examples deal with a simple red/green/yellow light. The same scenarios and rules may be applied to more complex lights such as turn signals. There are two categories of turning lanes: a) turning lanes with a dedicated traffic light and b) turning lanes that share a traffic light with a route that goes straight through the intersection. Turning lights may share the same regions prior to the intersection (for example A in the above used examples) and the same INT region. However, turning paths have a different end point (for example, C in the above used examples).

Turning lanes with dedicated traffic lights may be treated the same way as straight-going routes. A turning route controlled by a dedicated traffic light experiences same vehicle behavior as a straight path. In both cases vehicles wait when the light is red and cross the intersection when it is green. In other words, similar to a straight path, a turning path does not have yield to vehicles from another path. Congestion affects vehicle behavior in both paths the same way.

A turning route without a dedicated traffic light may be treated differently as it exhibits different vehicle behavior. Vehicles in a turning lane yield to opposite traffic. Quite often multiple vehicles move into the center of the intersection, waiting for an opportunity to turn. When their (and opposite direction's) traffic light switches from green to red, according to traffic rules only one vehicle is allowed to make a turn. However, in real life it is common to see multiple vehicles already in the intersection making a turn after the light turns red. A similar approach as in FIG. 10 may be applied in such a case. A longer time buffer may be applied for turns with no dedicated turning light or keep the time buffer the same and not catch as many abnormal crossings.

The methodology to detect whether a traffic light state is stuck in red is different than that of intersection wide malfunctions. Congestion of the crossing paths before and after the intersection may be used to determine a malfunction of a single traffic light. If a certain pattern is observed, then the location cloud 121 may determine that a specific traffic light is, for example, stuck at red state. Single light outages are determined on a light to light basis and not necessarily for the entire traffic signal 126.

Figure 11C:
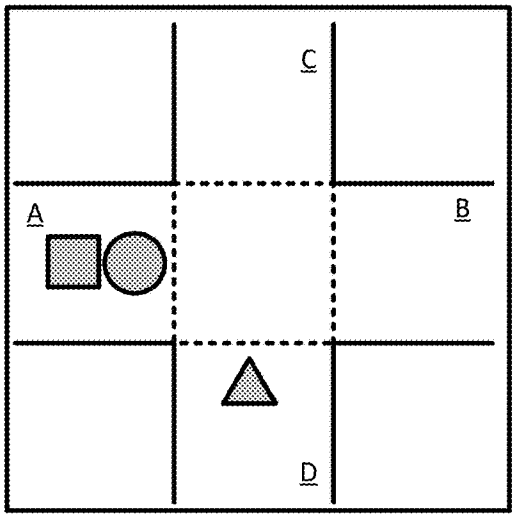
FIGS. 11A, 11B, and 11C illustrate an example intersection with a traffic light.
Figure 11B:
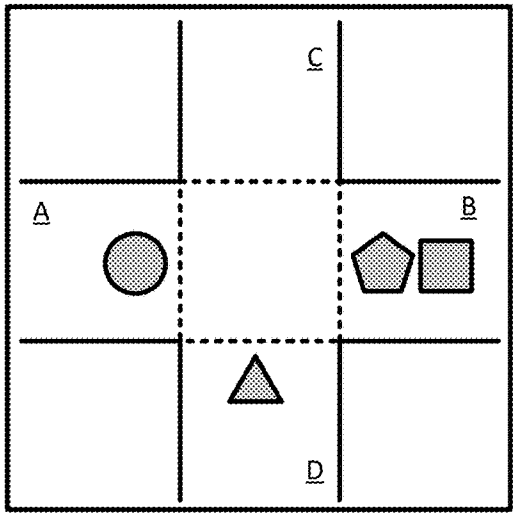
Figure 11A:
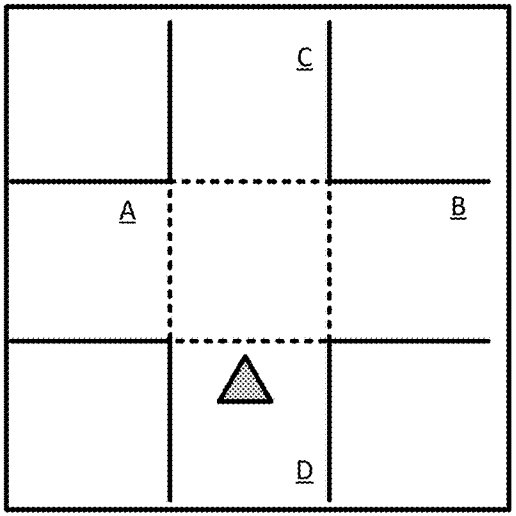

FIGS. 11A, 11B, and 11C depicts examples for detecting when a traffic light is stuck. For each of these example, the path AB has a green light. A first scenario may be where no vehicles cross the intersection during a half light cycle (AB has a green, DC has a red light). There could be a number of explanations for the lack of vehicles in the intersection from either of AB or DC paths. The AB path's light may not be green as it is supposed to be but rather is stuck at red. Alternatively, there is no traffic on the AB path; hence no vehicles are crossing the intersection. There are vehicles on AB path; however, the vehicles cannot cross the intersection as there is congestion after the intersection. If a vehicle makes an attempt to cross the intersection, the vehicle may get stuck in the middle of the intersection. Only the first explanation is caused by a traffic light malfunction. The other two explanations are results of traffic conditions and not due to a problem with traffic lights. Congestion may be measured in multiple ways. A simple method may determine if any vehicles are queued up (congested) at the intersection or not (not congested). For example, two or more stationary vehicles prior to an intersection may be considered congestion.

In FIG. 11A, there is no congestion at either A or B. In this scenario, no vehicles are observed on the AB even though there is no congestion either before or after the intersection. This scenario is in line with the second possibility above, potentially indicating that there is no traffic on AB pointing towards GLD route having no traffic at all. The lack of congestion indicates that the traffic light is not malfunctioning.

In FIG. 11B, there is no congestion at A. There is congestion at B. This scenario most likely is where while there are vehicles on AB path; the vehicles cannot cross the intersection as there is congestion after the intersection. Regardless of any congestion before the intersection, the presence of congestion after the intersection explains why no vehicles on GLD route are crossing the intersection. The traffic light is classified as not malfunctioning. This scenario also applies to if there is congestion at A and B. The fact that there is congestion after the intersection explains why vehicles at A are not crossing the intersection.

In FIG. 11C, there is congestion at A, there is no congestion at B. This scenario is in line with behavior observed when a traffic light gets stuck at red. Even though light state is supposed to the green, cars are not crossing the intersection. There is congestion before the intersection, but not after the intersection, which means that vehicles before the intersection are not waiting for traffic ahead to clear out. If this behavior is observed for one green phase of the traffic light only, then it might be explained by a driver not paying attention to traffic light. If the behavior is observed over multiple green cycles, then the specific traffic light is most likely stuck at red.

For each of these scenarios, if there is an accident or other identified traffic incident that may cause a vehicle to be stuck at a red light, the traffic light may assume to be functioning properly.

Referring back to FIG. 4, at act A160, if the location cloud 121 finds an abnormal crossing, the location cloud 121 increments an abnormality score for the traffic signal 126. At act A170, the traffic signal 126 is determined to be malfunctioning depending on the abnormality score. The abnormality score may be whole number that is kept for at least a full intersection wide cycle (each light has had a chance to go both red and green) and possibly for additional cycles. At the beginning of a cycle, the abnormality score is set to 0. The abnormality score is increment with each abnormal crossing until the end of the cycle. If during this time, the score exceeds the threshold, a traffic signal malfunction is determined. Otherwise, the score is reset to 0 for the next cycle. For multiple cycles, at the beginning, the score is set to 0 and is kept until the end of the cycle or the threshold is reached.

The abnormality score may be discounted depending on the scenario. For example, older abnormal crossing may be counted less than more recent abnormal crossings. Back to back or temporally similar abnormal crossings may be counted more.

Once a traffic light malfunction is determined, the location cloud 121 may update the database 123 and transmit an alert. The map database 123 may be used to generate routes or for other navigational services. A malfunctioning signal or light may affect the traffic pattern and travel times. The location cloud 121 may transmit an alert to vehicles within a threshold range of the malfunctioning light. The threshold range may include the area that is affected by altered traffic patterns due to the malfunctioning traffic signal. Any vehicles that may avoid the expected traffic congestion may be sent an alternative route.

In certain embodiments, an autonomous vehicle may take action when a malfunctioning traffic signal 126 is identified. As described herein, an autonomous driving vehicle may refer to a self-driving or driverless mode that no passengers are required to be on board to operate the vehicle. An autonomous driving vehicle may be referred to as a robot vehicle or an autonomous driving vehicle. The autonomous driving vehicle may include passengers, but no driver is necessary. Autonomous driving vehicles may park themselves or move cargo between locations without a human operator. Autonomous driving vehicles may include multiple modes and transition between the modes.

As described herein, a highly assisted driving (HAD) vehicle may refer to a vehicle that does not completely replace the human operator. Instead, in a highly assisted driving mode, the vehicle may perform some driving functions and the human operator may perform some driving functions. Vehicles may also be driven in a manual mode that the human operator exercises a degree of control over the movement of the vehicle. The vehicles may also include a completely driverless mode. Other levels of automation are possible.

The autonomous or highly automated driving vehicle may include sensors for identifying the surrounding environment and location of the car. The sensors may include GNSS, light detection and ranging (LIDAR), radar, and cameras for computer vision. Proximity sensors may aid in parking the vehicle. The proximity sensors may detect the curb or adjacent vehicles. The autonomous or highly automated driving vehicle may optically track and follow lane markings or guide markings on the road.

Autonomous or highly automated driving vehicle may require high definition up to date maps. Identifying a malfunctioning light not only assists in identifying hazards (or potentially unexpected stopped traffic), but also may help with routing decisions (e.g. avoiding highly congested areas).

The location cloud 121 may communicate alerts using the network. The location cloud 121 may send a message or alert to an agency, entity, or server that is responsible for fixing the malfunctioning traffic signal 126.

Figure 12:
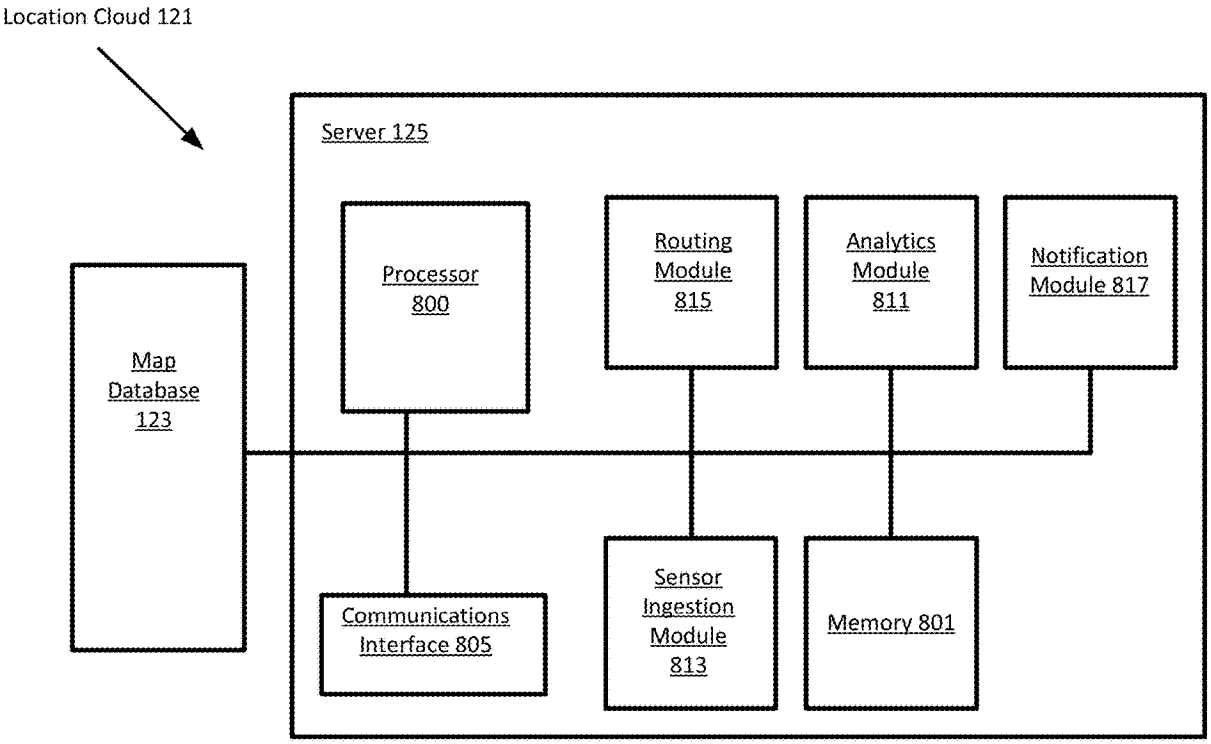
FIG. 12 illustrates an example location cloud of the system of FIG. 2.

FIG. 12 illustrates an example location cloud 121 of FIG. 2. The location cloud 121 includes a server 125 and a database 123. The server 125 may include a sensor ingestion module 813, an analytics module 811, a routing module 815, a notification module 817, a processor 800, a communications interface 805, and a memory 801. The processor 800 may be connected to the database 123. Each of the modules may be included within the processor 800 or may be separate processing centers or devices. Each of the modules may also be connected to the database 123 in order to access current and historical geographical and network usage data.

The server 125 and associated modules are configured to receive probe reports or messages using the communications interface 805. The server 125 may be configured to identify one or more malfunctioning traffic lights or signals using data from the probe reports. The server 125 may be configured to generate an alert in response to determining that a traffic light or signal has malfunctioned. The server 125 may be configured to communicate preemptive measures to one or more connected devices 122 in response to the malfunctioning traffic light or signal.

The processor 800 may be the means to receive collected data from the device(s), determine a traffic light has malfunctioned generate an alert. The processor 800 may be configured to request and receive data through the communication interface. The processor 800 may also be configured to access the database 123 including current and historical data.

The sensor ingestion module 813 may be the means for receiving probe reports through the communications interface 805 and identifying data such as location and timing data. The sensor ingestion module 813 may be configured to group probe reports for each device 122.

The routing module 815 may be the means for generating paths from the location and timing data. The routing module 815 may be configured to retrieve data from the database 123 regarding the roadways and current or historical traffic patterns. The routing module 815 may be configured to map match location estimates from the probe reports.

The analytics module 811 may be the means for determining if the paths are abnormal crossings. The analytics module 811 may be configured to retrieve SPaT information from the database 123 and compare the information against paths generated by the routing module 815. The analytics module 811 may be configured to determine that a crossing of the intersection in a path occurred during a red light phase of the traffic signal 126. The analytics module 811 may be configured to determine that a first location of the path, prior to the intersection was traversed during the red light phase and that a second location of the path, subsequent to or in the intersection was traversed during the red light phase. The analytics module 811 may be configured to determine that a first location of the path, in the intersection was traversed during the red light phase, that a second location of the path, subsequent to the intersection was traversed during the red light phase, and that the first location was traversed at a time later than a start of the red light phase plus a buffer time value. The analytics module 811 may be configured to identify a route across the intersection with no paths through the intersection, determine there is congestion prior to the intersection, determine there is no congestion after the intersection, and identify a traffic light for the route is malfunctioning.

The notification module 817 may be the means for generating and transmitting notification or alerts. The notification module 817 may generate and transmit alerts when the abnormality score has exceeded a threshold score for an intersection. The notification module 817 may generate and transmit alerts to an agency responsible for the traffic signal 126, devices 122 connected to the network, and other navigation applications or services. The notification module may update the map database 123.

Figure 13:
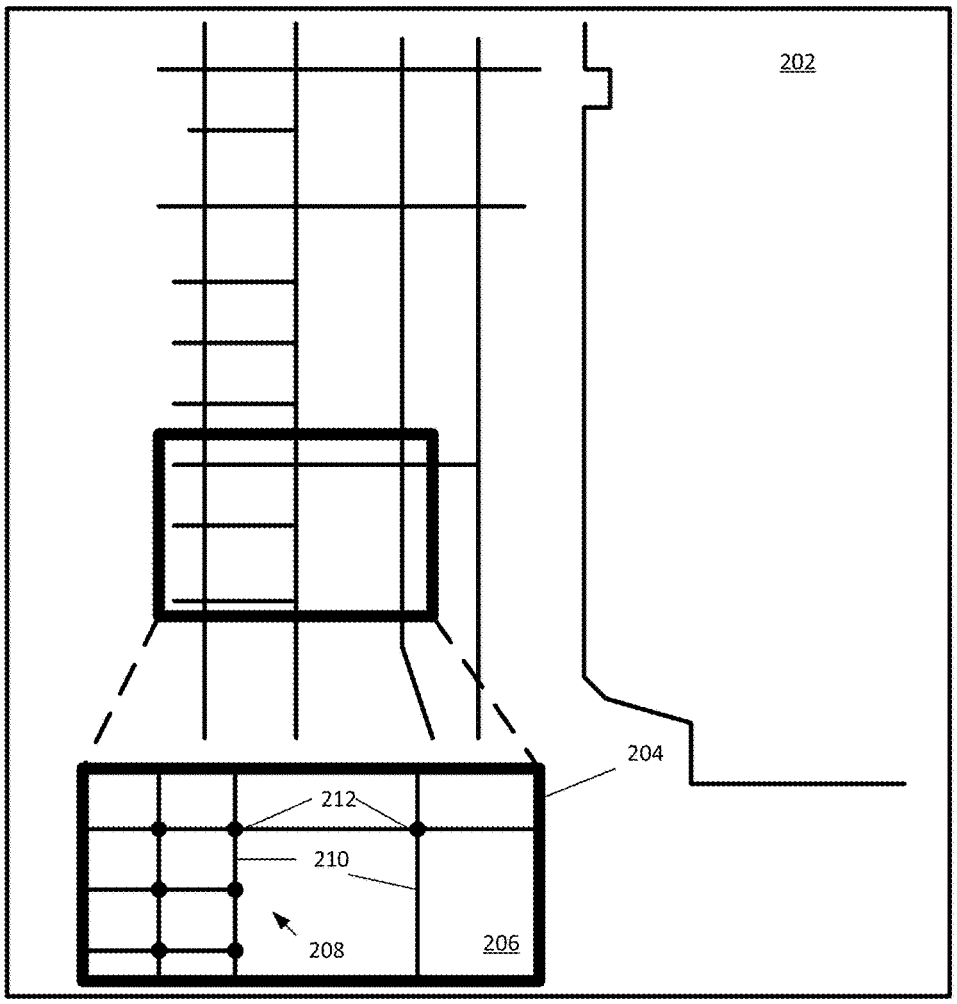
FIG. 13 illustrates an example map of a geographic region.

The database 123 may be configured to store a map and map attributes for a geographic region. FIG. 13 illustrates an example map of a geographic region 202. The geographic region 202 may correspond to a metropolitan or rural area, a state, a country, or combinations thereof, or any other area. Located in the geographic region 202 are physical geographic features, such as roads, points of interest (including businesses, municipal facilities, etc.), lakes, rivers, railroads, municipalities, etc.

FIG. 13 further depicts an enlarged map 204 of a portion 206 of the geographic region 202. The enlarged map 204 illustrates part of a road network 208 in the geographic region 202. The road network 208 includes, among other things, roads and intersections located in the geographic region 202. As shown in the portion 206, each road in the geographic region 202 is composed of one or more road segments 210. A road segment 210 represents a portion of the road. Each road segment 210 is shown to have associated with the road segment 210, two nodes 212; one node represents the point at one end of the road segment and the other node represents the point at the other end of the road segment. The node 212 at either end of a road segment 210 may correspond to a location at which the road meets another road, i.e., an intersection, or where the road dead-ends.

Figure 14:
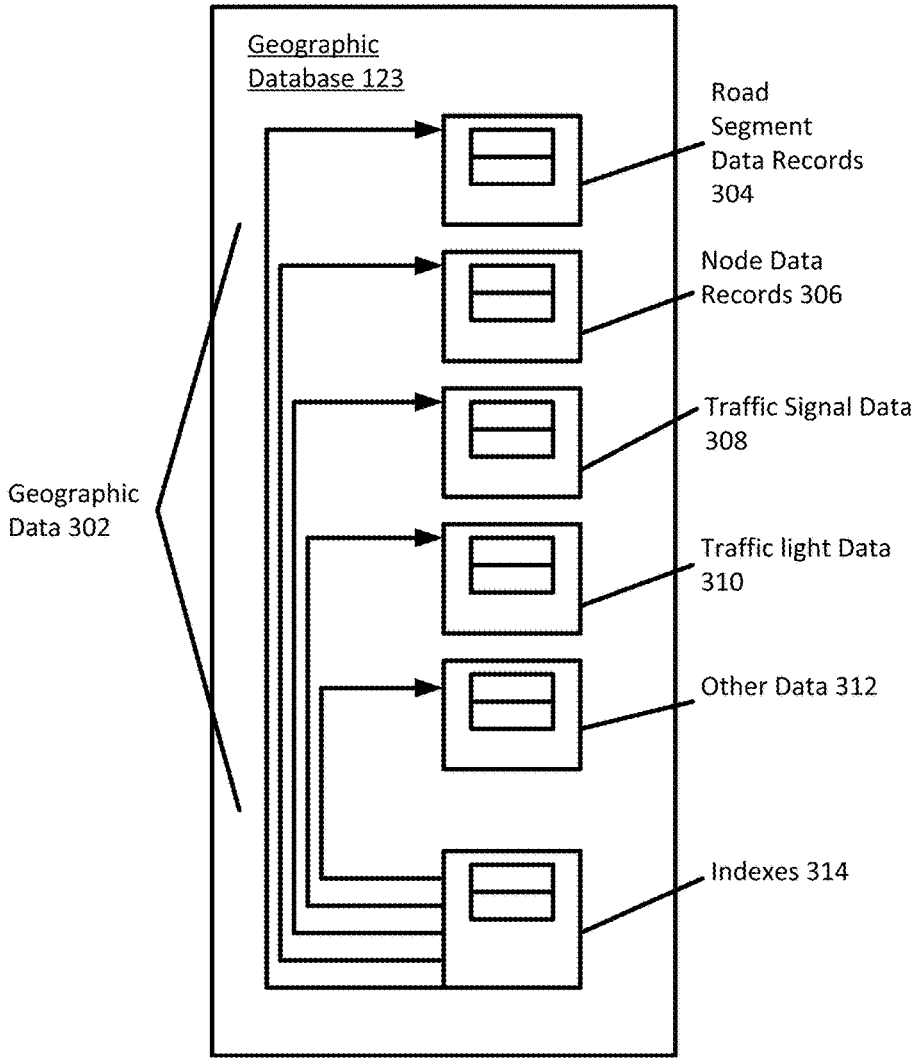
FIG. 14 illustrates an example geographic database of FIG. 2.

FIG. 14 depicts an example geographic database 123. The geographic database 123 contains data 302 that represents some of the physical geographic features in the geographic region 202 depicted in FIG. 3. The data 302 contained in the geographic database 123 may include data that represent the road network 208. In the embodiment of FIG. 4, the geographic database 123 that represents the geographic region 202 may contain at least one road segment database record 304 (also referred to as "entity" or "entry") for each road segment 210 in the geographic region 202. The geographic database 123 that represents the geographic region 202 may also include a node database record 306 (or "entity" or "entry") for each node 212 in the geographic region 202. The terms "nodes" and "segments" represent only one terminology for describing the physical geographic features, and other terminology for describing the features is intended to be encompassed within the scope of the concepts.

The geographic database 123 may also include other kinds of data 312. The other kinds of data 312 may represent other kinds of geographic features or anything else. The other kinds of data may include point of interest data. For example, the point of interest data may include point of interest records including a type (e.g., the type of point of interest, such as restaurant, hotel, city hall, police station, historical marker, ATM, golf course, etc.), location of the point of interest, a phone number, hours of operation, etc. The geographic database 123 also includes indexes 314. The indexes 314 may include various types of indexes that relate the different types of data to each other or that relate to other aspects of the data contained in the geographic database 123. For example, the indexes 314 may relate the nodes in the node data records 306 with the end points of a road segment in the road segment data records 304. As another example, the indexes 314 may relate point of interest data in the other data records 312 with a road segment in the segment data records 304.

Figure 15:
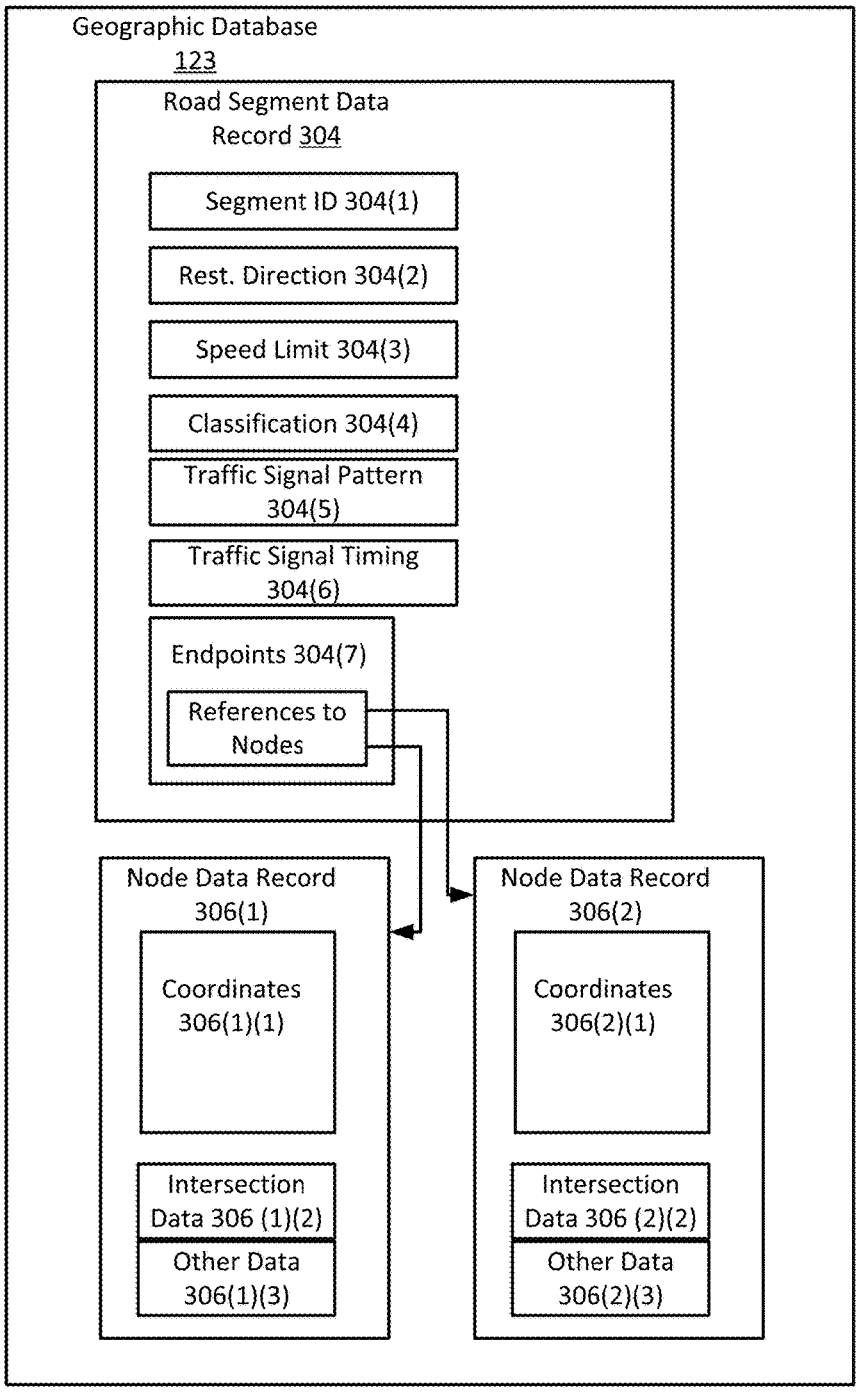
FIG. 15 illustrates example components of the geographic database of FIG. 14.

FIG. 15 depicts some of the components of a road segment data record 304 contained in the geographic database 123 according to one embodiment. The road segment data record 304 may include a segment ID 304(1) by which the data record can be identified in the geographic database 123. Each road segment data record 304 may have associated with it information (such as "attributes", "fields", etc.) that describes features of the represented road segment. The road segment data record 304 may include data 304(2) that indicate the restrictions, if any, on the direction of vehicular travel permitted on the represented road segment. The road segment data record 304 may include data 304(3) that indicate a speed limit or speed category (i.e., the maximum permitted vehicular speed of travel) on the represented road segment. The road segment data record 304 may also include data 304(4) indicating whether the represented road segment is part of a controlled access road (such as an expressway), a ramp to a controlled access road, a bridge, a tunnel, a toll road, a ferry, and so on.

Data for traffic signals 126 may be stored as separate records 308, 310 or in road segment data records 304. The traffic signal data 308 and traffic light data 310 may include data such as SPaT data for individual traffic signals 126. The data for the traffic signals 126 may include data as it relates to other information in the geographic database 123 such as road segment data records 304. The geographic database 123 may include road segment data records 304 (or data entities) that describe features such as signal phase 304(5) or signal timing 304(6). Additional geographic and network usage data may be stores in other data 312. The attribute data may be stored in relation to a link/segment 304, a node 306, a strand of links, an area, or a region.

The geographic database 123 may store information or settings for display preferences. The geographic database 123 may be coupled to a display. The display may be configured to display the roadway network and data entities using different colors or schemes. The geographic database 123 may store and display information relating to where conditions or malfunctions may exist or have existed, for example, through analysis of the current and historical traffic conditions.

The road segment data record 304 also includes data 304(7) providing the geographic coordinates (e.g., the latitude and longitude) of the end points of the represented road segment. In one embodiment, the data 304(7) are references to the node data records 306 that represent the nodes corresponding to the end points of the represented road segment.

The road segment data record 304 may also include or be associated with other data 304(7) that refer to various other attributes of the represented road segment. The various attributes associated with a road segment may be included in a single road segment record, or may be included in more than one type of record that cross-references to each other. For example, the road segment data record 304 may include data identifying what turn restrictions exist at each of the nodes that correspond to intersections at the ends of the road portion represented by the road segment, the name or names by which the represented road segment is known, the street address ranges along the represented road segment, and so on.

FIG. 15 also shows some of the components of a node data record 306 that may be contained in the geographic database 123. Each of the node data records 306 may have associated information (such as "attributes", "fields", etc.) that allows identification of the road segment(s) that connect to it and/or a geographic position (e.g., its latitude and longitude coordinates or location in a cellular map or network). For the embodiment shown in FIG. 5, the node data records 306(1) and 306(2) include the latitude and longitude coordinates 306(1)(1) and 306(2)(1) for their node. The node data records include the traffic signal data 306(1)(2) and 306(2)(2). The traffic signal data may store SPaT data or traffic data relating to the intersection (flow, speed, etc.). The traffic light data records 306(1) and 306(2) may also include other data 306(1)(3) and 306(2)(3) that refer to various other attributes of the individual traffic light. The traffic light data may, for example, store turning restrictions or alternative patterns for certain times of the day for each individual traffic light.

The geographic database 123 may be maintained by a content provider (e.g., a map developer). By way of example, the map developer may collect geographic data to generate and enhance the geographic database 123. The map developer may obtain data from sources, such as businesses, municipalities or respective geographic authorities. In addition, the map developer may employ field personnel to travel throughout the geographic region to observe features and/or record information about the roadway. Remote sensing, such as aerial or satellite photography, may be used.

The geographic database 123 and the data stored within the geographic database 123 may be licensed or delivered on-demand. Other navigational services or MNOs may access the traffic data and the traffic signal malfunction data stored in the geographic database 123. Traffic signal malfunction data may be broadcast as a service.

Figure 16:
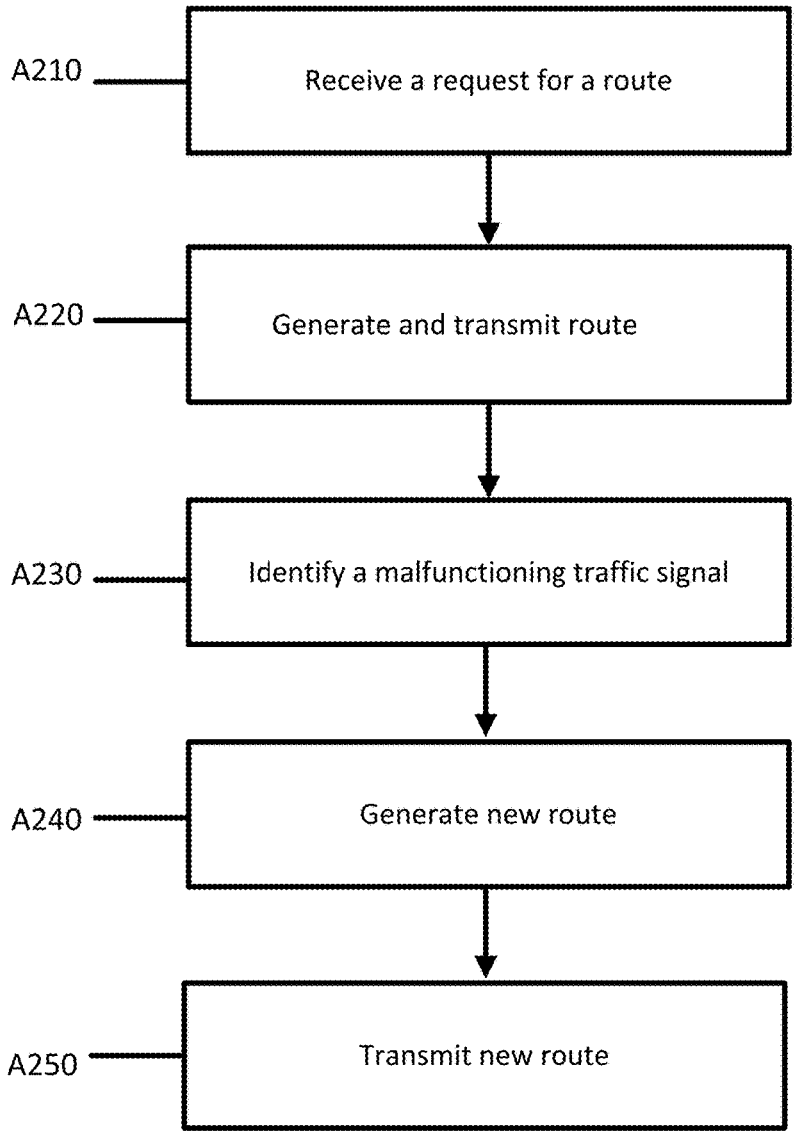
FIG. 16 illustrates an example workflow for transmitting a notification relating to a traffic signal malfunction.

FIG. 16 illustrates a flow chart of a method for generating a route while avoiding a malfunctioning traffic signal 126 using the location cloud 121 of FIG. 2. As presented in the following sections, the acts may be performed using any combination of the components indicated in FIG. 2. Additional, different, or fewer acts may be provided. The acts are performed in the order shown or other orders. The acts may also be repeated.

Figure 17:
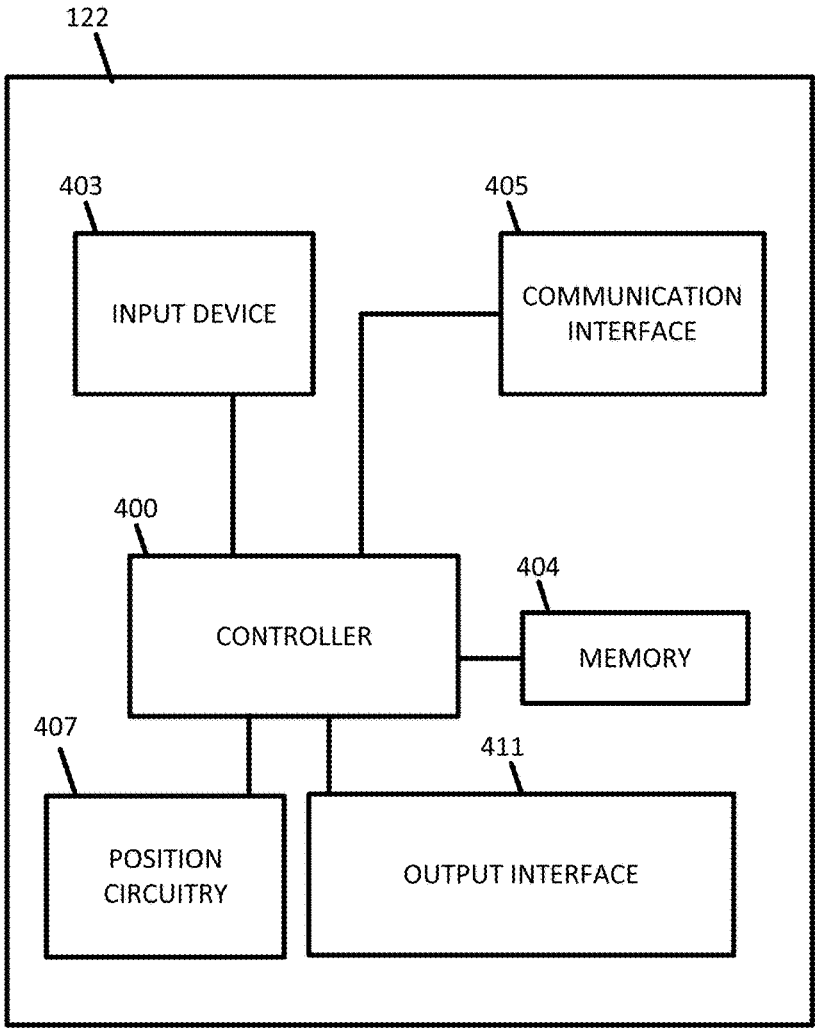
FIG. 17 illustrates an example device of the system of FIG. 2.

At Act 210, the location cloud 121 receives a request for a route. The request may be received from a device 122. FIG. 17 depicts an example device 122. The device 122 may be the means for transmitting and receiving traffic related data including probe reports and routing information. The device 122 may be configured to generate or receive a route and display the route for a user. The device 122 includes an input device 403, a communications interface 405, a controller 400, a memory 404, position circuitry 407, and an output interface 411. The device 122 may be configured to receive a traffic light malfunctioning message from a location cloud 121. The device 122 may be configured to take preemptive actions relating to malfunctioning traffic signal 126 such as generating a different route.

The memory 404 and/or memory 801 may be a volatile memory or a non-volatile memory. The memory 404 and/or memory 801 may include one or more of a read only memory (ROM), random access memory (RAM), a flash memory, an electronic erasable program read only memory (EEPROM), or other type of memory. The memory 204 and/or memory 801 may be removable from the mobile device 122, such as a secure digital (SD) memory card. The memory may contain a locally stored map database.

The controller 400 and/or processor 800 may include a general processor, digital signal processor, an application specific integrated circuit (ASIC), field programmable gate array (FPGA), analog circuit, digital circuit, combinations thereof, or other now known or later developed processor. The controller 400 and/or processor 300 may be a single device or combinations of devices, such as associated with a network, distributed processing, or cloud computing. The controller 400 may be configured to receive position information from the positioning circuitry 407 and transmit a location of the device 122.

The positioning circuitry 407, that is an example of a positioning system, is configured to determine a geographic position of the device 122. The positioning circuitry may use, for example, a GPS receiver to determine the location of the device 122. The positioning circuitry may include movement circuitry. The movement circuitry, that is an example a movement tracking system, is configured to determine movement of a device 122. The position circuitry 407 and the movement circuitry may be separate systems, or segments of the same positioning or movement circuitry system. In an embodiment, components as described herein with respect to the device 122 may be implemented as a static device.

The input device 403 may be one or more buttons, keypad, keyboard, mouse, stylist pen, trackball, rocker switch, touch pad, voice recognition circuit, or other device or component for inputting data to the device 122. The input device 403 and the output interface 411 may be combined as a touch screen that may be capacitive or resistive. The output interface 411 may be a liquid crystal display (LCD) panel, light emitting diode (LED) screen, thin film transistor screen, or another type of display. The output interface 411 may also include audio capabilities, or speakers.

The communication interface 405 and/or communication interface 805 may include any operable connection. An operable connection may be one in which signals, physical communications, and/or logical communications may be sent and/or received. An operable connection may include a physical interface, an electrical interface, and/or a data interface. The communication interface 405 and/or communication interface 805 provides for wireless and/or wired communications in any now known or later developed format. The communication interface 405 and/or communication interface 805 may include a receiver/transmitter for digital radio signals or other broadcast mediums. A receiver/transmitter may be externally located from the device 122 such as in or on a vehicle.

At Act 220, the location cloud 121 generates and transmits the route. The route may include a requested starting point (or a current position of the device 122) and a requested destination. The route may be generated based on distance, time, efficiency, or other factors. The route may include one or more road segments that connect the starting point and the destination including one or more intersections with one or more traffic signals 126. The route may be provided with traffic information from the map database 123.

At Act 230, the location cloud 121 identifies a traffic signal 126 that is malfunctioning on the route. The location cloud 121 may receive multiple probe reports from different vehicles or devices 122 traveling the roadway. From the probe reports, the location cloud 121 may be able to determine if an unconnected traffic signal 126 or traffic light has malfunctioned.

There are three types of malfunctioning traffic signals 126. A traffic signal 126 may be shut down completely. A traffic signal 126 may be malfunctioning and for example, showing blinking red lights. One or more traffic lights in the traffic signal 126 may be out of order or not working. For the first two example above, a malfunctioning traffic light may be determined by counting a number of abnormal crossing for a time period and comparing the count against a threshold number for the intersection.

Figure 18:
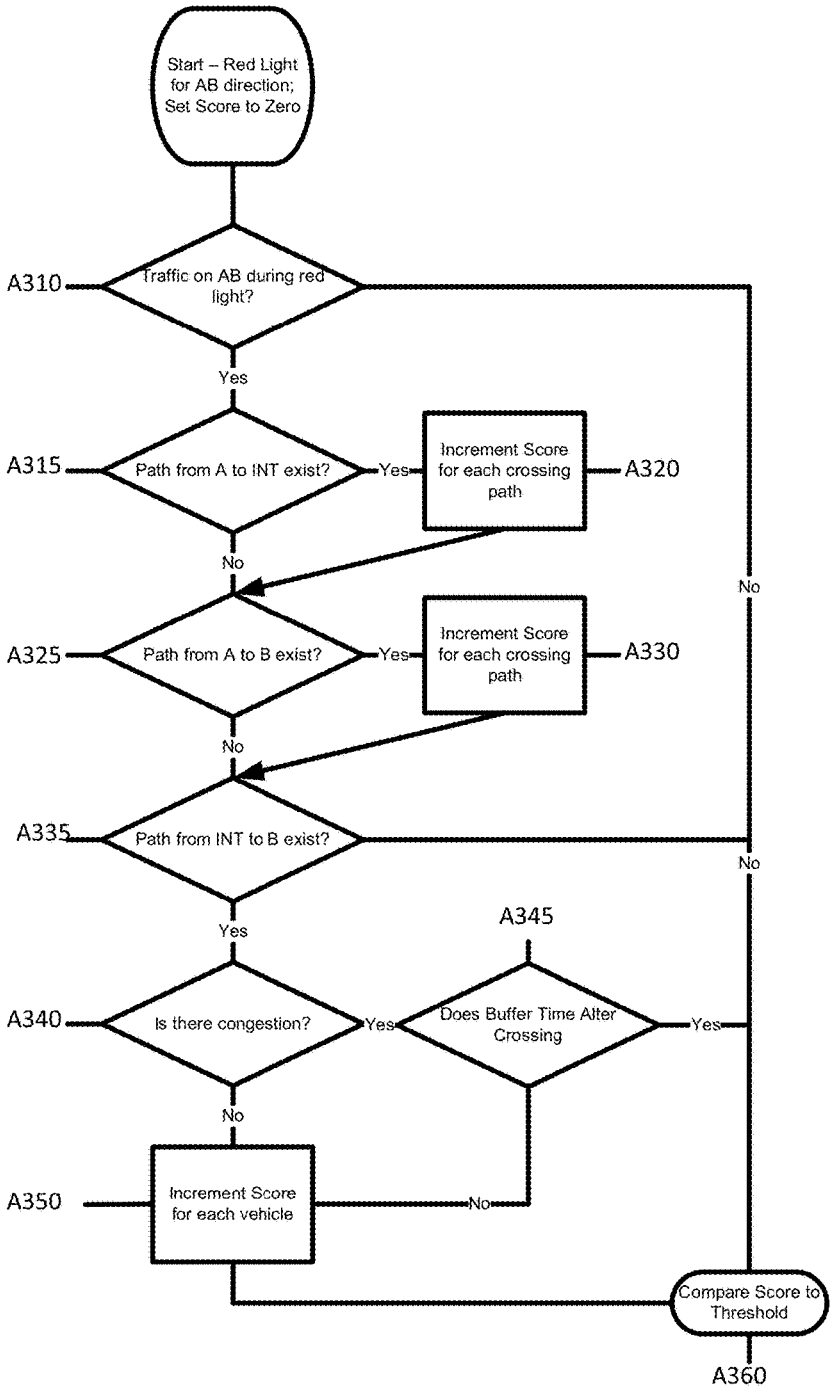
FIG. 18 illustrates an example workflow for identifying a malfunctioning traffic signal.

An abnormal crossing may be a crossing of the intersection against a red light. The scenarios in FIGS. 5 through 10 describe above describe several scenarios and whether a crossing is abnormal or normal. The flowchart in FIG. 18 illustrates the acts for determining that there is a traffic signal malfunction. As presented in the following sections, the acts may be performed using any combination of the components indicated in FIG. 2. The following acts may be performed by the location cloud 121, or a combination thereof. Additional, different, or fewer acts may be provided. The acts are performed in the order shown or other orders. The acts may also be repeated.

The location cloud 121 may have previously received multiple reports from one or more devices 122. The location cloud 121 may generate paths for each of the devices 122. For each of the paths, the following is assumed. The traffic signal 126 controls crossings from A to B. The intersection is designated by INT. For each of the locations that a report is received, the traffic signal 126 has a red light.

At act A310, the location cloud 121 determines if there was a crossing during a red light. If there was not a crossing during a red light, the process ends and the abnormality score is compared against a threshold at Act A360. Act A310 may wait for a complete cycle of lights to run. Act A310 may wait for multiple cycles, such as 2, 5, 10, 20 cycles to run. If there as a crossing during a red light phase, the process moves on to Act A315.

At act A315, the location cloud 121 determines if the one or more crossings includes a path from A to INT. A path from A to INT on red indicates that the vehicle entered the intersection while the light was red. This is considered an abnormal crossing and at act A320, the abnormality score is increased by the number of paths that are from A to INT.

At act A325, the location cloud 121 determines if the one or more crossings includes a path from A to B. A path from A to B on red indicates that the vehicle entered the intersection while the light was red. This is considered an abnormal crossing and at act A330, the abnormality score is increased by the number of paths that are from A to B.

At act A335, the location cloud 121 determines if a path from INT to B exists. If no paths from just INT to B, then the process ends and the abnormality score is compared against a threshold. If there is a path from INT to B, the process moves on to A340. If there is not a path, the process ends and the abnormality score is compared against a threshold at Act A360.

At act A340, the location cloud 121 determines if there was congestion at B for the period the path from INT to B exists. If there is congestion, the crossing is considered an abnormal crossing and at act A350, the abnormality score is increased by the number of paths that are from INT to B. If there is no congestion, the process moves to act A345.

At act A345, a buffer time is used to adjust the INT report time. Under normal circumstances, the path between INT to B on a red light may indicate an abnormal crossing. However, drivers or vehicle may enter the intersection on a yellow and exit on a red light. A time buffer is subtracted from the INT time to determine if the vehicle entered on a yellow or green light. For example, if the time for the INT report is less than 2 seconds after the light turned red, the vehicle could have entered on the yellow. The buffer time may vary from one intersection to another depending on the length of the intersection (INT). The buffer time may also vary depending on the type of roadway, the length of the yellow light, the speed limit (or expected speed), or the traffic flow. The buffer time may be increased to account for vehicles that run a red light (right after it turns red). While not desirable, such a crossing does not indicate that the traffic signal 126 has malfunctioned. If the buffer time does not alter the circumstance (the vehicle still most likely entered on red), then the crossing is considered an abnormal crossing and at act A350, the abnormality score is increased. If the buffer time does alter the crossing, the process ends and the abnormality score is compared against a threshold at Act A360.

At Act A360, the total abnormality score is compared to a threshold score. At the beginning of a cycle, the abnormality score is set to 0. The abnormality score is incremented with each abnormal crossing according to the flowchart of FIG. 18 until the end of the cycle. If during this time, the score exceeds the threshold, a traffic signal malfunction is determined. Otherwise, the score is reset to 0 for the next cycle. For multiple cycles, at the beginning, the score is set to 0 and is kept until the end of the cycle or the threshold is reached.

Figure 19:
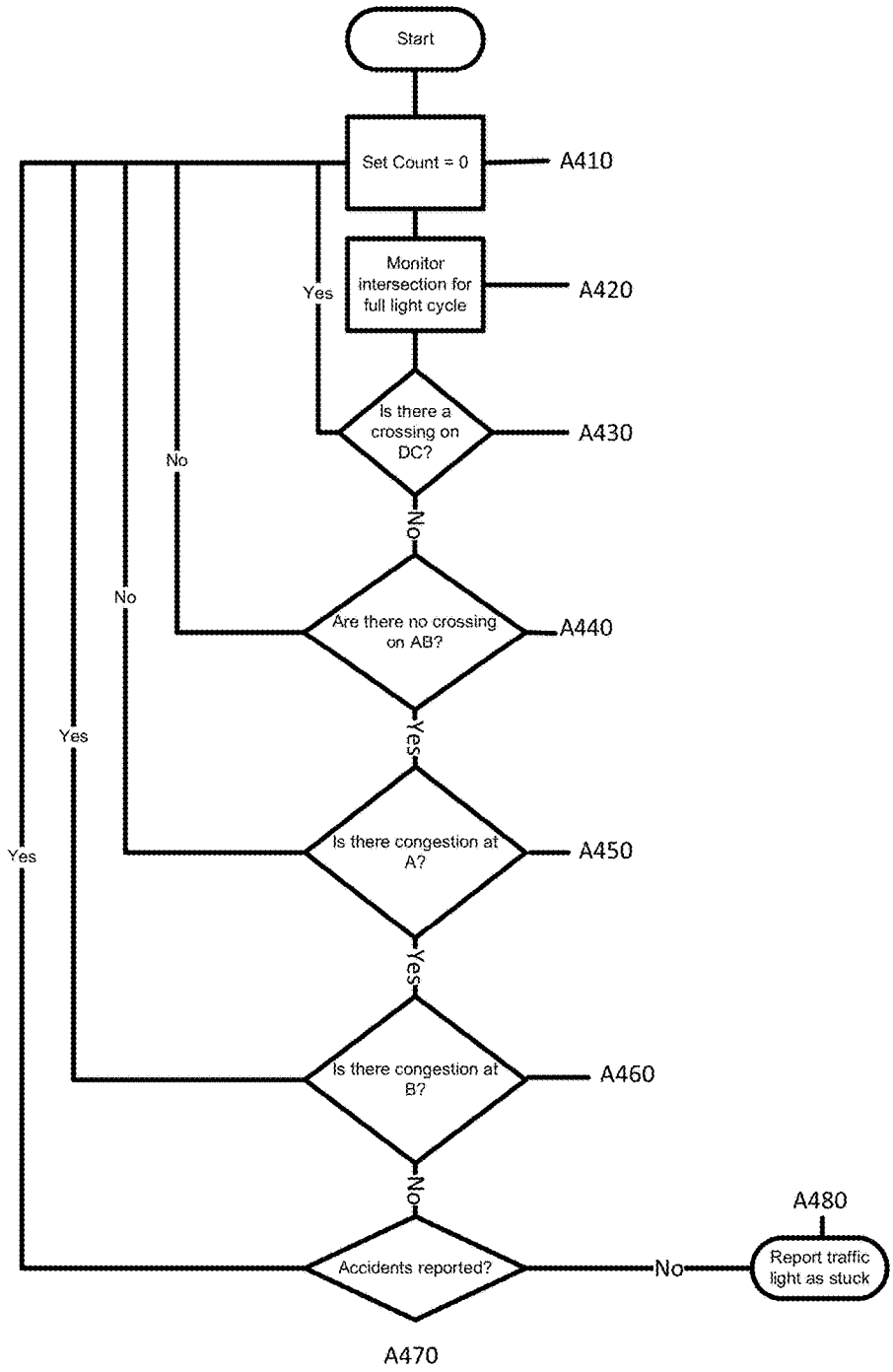
FIG. 19 illustrates an example workflow for identifying a malfunctioning traffic light.

In addition to the traffic signal 126 completely malfunctioning, a single light (or one direction) may malfunction. The flow chart in FIG. 19 illustrates a method for identifying a single malfunctioning traffic light. As presented in the following sections, the acts may be performed using any combination of the components indicated in FIG. 2. The following acts may be performed by the cellular system 129, the location cloud 121, or a combination thereof. Additional, different, or fewer acts may be provided. The acts are performed in the order shown or other orders. The acts may also be repeated.

At act A410, a counter is set to zero. The counter counts the number of cycles.

At act A420, the intersection may be monitored for a full light cycle. A full light cycle may be the total time of a green+a red light+a yellow light.

At act A430, the location cloud 121 determines if there is a crossing on a DC path (as depicted in FIGS. 11A, 11B, and 11C). As described above, the location cloud 121 may identify one or more paths for one or more vehicles. The location cloud 121 determines if the timing and location of a path intersect with an intersection. If there is a crossing on DC, the workflow restarts back at A410.

At act A440, the location cloud 121 determines if there is a crossing on AB (as depicted in FIGS. 11A, 11B, and 11C). If there are crossings on AB, the traffic light is not malfunctioning and the workflow restarts at A410. If there are no crossing at AB, the workflow continues to A450.

At act A450, the location cloud 121 determines if there is congestion at A (the segment before the intersection on the route AB). If there is congestion, the workflow continues to A460. If there is not congestion, the workflow restarts back at A410.

At act A460, the location cloud 121 determines if there is congestion at B (the segment after the intersection on the route AB). If there is not congestion, the workflow continues to A460. If there is congestion, the workflow restarts back at A410.

At act A470, the location cloud 121 identifies any accidents or traffic events that would stall traffic at the intersection. If there are traffic incidents reported, the workflow restarts back at A410. If there are no traffic incidents, the workflow continues to A480. At act A480, the location cloud 121 identifies that the traffic light may be stuck on a red light.

Referring back to the flowchart of FIG. 16, at act A240, the location cloud 121 generates a new route that does not include the intersection. A malfunctioning traffic light may cause multiple issues including but not limited to increase congestion surrounding the intersection, less traffic flow, and increased travel times. As such, avoiding malfunctioning traffic lights may be a high priority. The location cloud 121 may identify any routes that include the traffic signal 126 and or identify any devices 122 that are expected to enter the affected region surrounding the traffic signal 126. The location cloud 121 may generate new routes that avoid the affected areas.

At act A250, the location cloud 121 transmits the new route to the device 122. The location cloud 121 may transmit an alert to devices 122 in the area. The devices 122 may use the alert to generate a new route around the affected area.

The term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

As used in this application, the term 'circuitry' or 'circuit' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Processors suitable for the execution of a computer program include, by way of example, both general and special purpose microprocessors, and anyone or more processors of any kind of digital computer. Generally, a processor receives instructions and data from a read only memory or a random access memory or both. The essential elements of a computer are a processor for performing instructions and one or more memory devices for storing instructions and data. Generally, a computer also includes, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Navigation Satellite System (GNSS) receiver, to name just a few. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The memory may be a non-transitory medium such as a ROM, RAM, flash memory, etc. The processor and the memory can be supplemented by, or incorporated in, special purpose logic circuitry.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

The following embodiments are disclosed.

Embodiment 1 a method for determining when a traffic signal associated with a road intersection is malfunctioning. The method comprises: identifying a traffic signal pattern for the traffic signal; receiving two or more probe reports from a device; generating a path including the road intersection for the device using location data in the two or more probe reports; comparing the path to the traffic signal pattern; determining an abnormal crossing from the comparison; and determining the traffic signal has malfunctioned.

Embodiment 2 the method of embodiment 1, further comprising incrementing an abnormality score for each abnormal crossing in a light cycle; wherein the determination the traffic signal has malfunctioned is based on the abnormality score.

Embodiment 3 the method of embodiments 1-2, further comprising transmitting a traffic signal malfunction message to an entity responsible for maintaining the traffic signal.

Embodiment 4 the method of embodiments 1-3, further comprising: transmitting a traffic signal malfunction message to one or more devices within a predetermined range of the road intersection.

Embodiment 5 the method of embodiments 1-4, wherein determining the traffic signal has malfunctioned based on the abnormality score comprises comparing the abnormality score for a traffic light cycle to a threshold abnormality score.

Embodiment 6 the method of embodiments 1-5, wherein the threshold is based on a duration of the traffic light cycle for the traffic signal.

Embodiment 7 the method of embodiments 1-6, wherein determining an abnormal crossing from the comparison comprises determining that a crossing of the road intersection in the path occurred during a red light phase of the traffic signal.

Embodiment 8 the method of embodiments 1-7, wherein determining that a crossing of the road intersection in the path occurred during the red light phase of the traffic signal comprises determining that a first location of the path, prior to the road intersection was traversed during the red light phase; and determining that a second location of the path, subsequent to or in the road intersection was traversed during the red light phase.

Embodiment 9 the method of embodiments 1-8, wherein determining that a crossing of the road intersection in the path occurred during the red light phase of the traffic signal comprises: determining that a first location of the path in the road intersection was traversed during the red light phase; determining that a second location of the path subsequent to the road intersection was traversed during the red light phase; and determining that the first location was traversed at a time later than a start of the red light phase plus a buffer time value.

Embodiment 10 the method of embodiments 1-9, wherein the buffer time value corresponds to a duration of a yellow light phase.

Embodiment 11 the method of embodiments 1-10, wherein determining an abnormal crossing from the comparison further comprises: determining there is no congestion after the road intersection.

Embodiment 12 the method of embodiments 1-11, wherein receiving, calculating, comparing and determining repeats for a full light cycle of the traffic signal.

Embodiment 13 the method of embodiments 1-12, further comprising: identifying a route across the road intersection with no paths through the road intersection; determining there is congestion prior to the road intersection; determining there is no congestion after the road intersection; and identifying a traffic light for the route is malfunctioning.

Embodiment 14 a system for determining when a traffic signal associated with a road intersection is malfunctioning, the system comprising: a map database configured to store data relating to the road intersection and signal, phase, and time data for the traffic signal; a sensor ingestion module configured to receive two or more probe reports from a sensor associated with a vehicle; a routing module configured to generate a path for a crossing of the road intersection for the vehicle from the two or more reports; and an analytics module configured to analyze the path and the signal, phase, and time data to determine if the crossing of the road intersection is an abnormality, the analytics module further configured to determine a malfunction of the traffic signal based on the abnormality.

Embodiment 15 the system of embodiment 14 further comprising: a notification module configured to generate and transmit an alert message regarding the malfunction of the traffic signal.

Embodiment 16 the system of embodiments 14-15, wherein the analytics module is further configured to determine there is congestion prior to the road intersection, determine there is no congestion after the road intersection, and identify that a traffic light of the traffic signal is malfunctioning.

Embodiment 17 a method for generating an updated route, the method comprising: receiving a request for a route; generating the route; providing the route; identifying a road intersection on the route with a malfunctioning traffic signal from one or more vehicle paths through the road intersection and signal, phase, and timing information for the malfunctioning traffic signal; generating an updated route not including the road intersection; and providing the updated route.

Embodiment 18 the method of embodiment 17, wherein identifying a road intersection on the route with a malfunctioning traffic signal comprises: generating a path of a vehicle through the intersection; and determining that a crossing of the road intersection in the path occurred during a red light phase of the traffic signal.

Embodiment 19 the method of embodiments 17-18, wherein determining that a crossing of the road intersection in a path occurred during the red light phase of the traffic signal comprises: determining that a first location of the path, prior to the road intersection was traversed during the red light phase; and determining that a second location of the path, subsequent to or in the road intersection was traversed during the red light phase.

Embodiment 20 the method of embodiments 17-19, wherein determining that a crossing of the road intersection in the path occurred during a red light phase of the traffic signal comprises: determining that a first location of the path in the road intersection was traversed during the red light phase; determining that a second location of the path subsequent to the road intersection was traversed during the red light phase; and determining that the first location was traversed at a time later than a start of the red light phase plus a buffer time value.

Embodiment 21 an apparatus, configured to perform and/or control the method of any of embodiments 1-13 or comprising means for performing and/or controlling any of embodiments 1-13.

Embodiment 22 an apparatus, comprising at least one processor and at least one memory including computer program code for one or more programs, the at least one memory and the computer program code configured to, with the at least one processor, to perform and/or control the method of any of embodiments 1-13.

Embodiment 23 a computer program comprising instructions operable to cause a processor to perform and/or control the method of any of embodiments 1-13, when the computer program is executed on the processor.

We claim:

1. A method for determining when a traffic signal associated with a road intersection is malfunctioning, the method comprising:

identifying, by a processor in a geographic database, a traffic signal pattern for the traffic signal;

receiving, by a sensor ingestion module, two or more probe reports from a device, wherein each of the two or more probe reports comprises at least location data and time data;

identifying, by a routing module, a path from a first location from a first probe report of the two or more probe reports to a second location of a subsequent probe report of the two or more probe reports, the path describing a portion of a roadway traversed by the device, wherein the road intersection is on the path between the first location and the second location;

comparing, by the processor, the path and time data to the traffic signal pattern;

determining, by the processor, an abnormal crossing of the road intersection from the comparison; and determining, by the processor, the traffic signal has malfunctioned.

2. The method of claim 1, further comprising:

incrementing, by the processor, an abnormality score for each abnormal crossing in a light cycle; wherein the determination the traffic signal has malfunctioned is based on the abnormality score.

3. The method of claim 1, further comprising:

transmitting, by a notification module, a traffic signal malfunction message to an entity responsible for maintaining the traffic signal.

4. The method of claim 1, further comprising:

transmitting, by a notification module, a traffic signal malfunction message to one or more devices within a predetermined range of the road intersection.

5. The method of claim 2, wherein determining the traffic signal has malfunctioned based on the abnormality score comprises:

comparing, by the processor, the abnormality score for a traffic light cycle to a threshold abnormality score.

6. The method of claim 5, wherein the threshold is based on a duration of the traffic light cycle for the traffic signal.

7. The method of claim 1, wherein determining an abnormal crossing from the comparison comprises:

determining, by the processor, that a crossing of the road intersection in the path occurred during a red light phase of the traffic signal.

8. The method of claim 7, wherein determining that a crossing of the road intersection in the path occurred during the red light phase of the traffic signal comprises:

determining, by the processor, that a first location of the path, prior to the road intersection was traversed during the red light phase; and determining, by the processor, that a second location of the path, subsequent to or in the road intersection was traversed during the red light phase.

9. The method of claim 7, wherein determining that a crossing of the road intersection in the path occurred during the red light phase of the traffic signal comprises:

determining, by the processor, that a first location of the path in the road intersection was traversed during the red light phase;

determining, by the processor, that a second location of the path subsequent to the road intersection was traversed during the red light phase; and determining, by the processor, that the first location was traversed at a time later than a start of the red light phase plus a buffer time value.

10. The method of claim 9, wherein the buffer time value corresponds to a duration of a yellow light phase.

11. The method of claim 9, wherein determining an abnormal crossing from the comparison further comprises:

determining, by the processor, there is no congestion after the road intersection.

12. The method of claim 1, wherein receiving, calculating, comparing and determining repeats for a full light cycle of the traffic signal.

13. The method of claim 1, further comprising:

identifying, by the routing module, for a time period that no vehicles have traversed a first route across the road intersection and that vehicles have traversed a second route across the road intersection;

determining, by the processor, there is congestion prior to the road intersection;

determining, by the processor, there is no congestion after the road intersection; and identifying, by the processor, a traffic light for the route is malfunctioning.

14. A system for determining when a traffic signal associated with a road intersection is malfunctioning, the system comprising:

a map database configured to store data relating to the road intersection and signal, phase, and time data for the traffic signal;

a sensor ingestion module configured to receive two or more probe reports from a sensor associated with a vehicle, each of the two or more probe reports comprising at least position data and time data;

a routing module configured to generate a path of the vehicle including a crossing of the road intersection from the position data and time data of the two or more reports; and an analytics module configured to analyze the path and the signal, phase, and time data to determine if the crossing of the road intersection is an abnormal crossing indicating that the crossing was performed during an expected red light phase of the traffic signal, the analytics module further configured to determine a malfunction of the traffic signal based on the abnormal crossing.

15. The system of claim 14 further comprising:

a notification module configured to generate and transmit an alert message regarding the malfunction of the traffic signal.

16. The system of claim 14, wherein the analytics module is further configured to determine there is congestion prior to the road intersection, determine there is no congestion after the road intersection, and identify that a traffic light of the traffic signal is malfunctioning.

17. A method for generating an updated route to avoid a malfunctioning traffic signal, the method comprising:

receiving, by a routing module, a request for a route;

generating, by the routing module, the route;

providing, by the routing module, the route;

identifying, by an analytics module, a road intersection on the route with the malfunctioning traffic signal, by a determination of one or more calculated vehicle paths indicating abnormal crossings through the road intersection, the determination based at least in part on signal, phase, and timing information for the malfunctioning traffic signal;

generating, by the routing module, an updated route not including the road intersection; and providing, by the routing module, the updated route.

18. The method of claim 17, wherein identifying a road intersection on the route with a malfunctioning traffic signal comprises:

generating, by the routing module, a path of a vehicle through the intersection; and determining, by the analytics module, that a crossing of the road intersection in the path occurred during a red light phase of the traffic signal.

19. The method of claim 18, wherein determining that a crossing of the road intersection in a path occurred during the red light phase of the traffic signal comprises:

determining, by the analytics module, that a first location of the path, prior to the road intersection was traversed during the red light phase; and determining, by the analytics module, that a second location of the path, subsequent to or in the road intersection was traversed during the red light phase.

20. The method of claim 18, wherein determining that a crossing of the road intersection in the path occurred during a red light phase of the traffic signal comprises:

determining, by the analytics module, that a first location of the path in the road intersection was traversed during the red light phase;

determining, by the analytics module, that a second location of the path subsequent to the road intersection was traversed during the red light phase; and determining, by the analytics module, that the first location was traversed at a time later than a start of the red light phase plus a buffer time value.

* * * * *